US008955772B2

(12) United States Patent
Ukigai et al.

(10) Patent No.: US 8,955,772 B2
(45) Date of Patent: Feb. 17, 2015

(54) WATER DISCHARGE APPARATUS

(75) Inventors: Kiyotake Ukigai, Kitakyushu (JP); Minoru Sato, Kitakyushu (JP); Katsuya Nagata, Kitakyushu (JP)

(73) Assignee: Toto Ltd., Fukuoka (JP)

( * ) Notice: Subject to any disclaimer, the term of this patent is extended or adjusted under 35 U.S.C. 154(b) by 866 days.

(21) Appl. No.: 13/166,606

(22) Filed: Jun. 22, 2011

(65) Prior Publication Data

US 2011/0315791 A1 Dec. 29, 2011

(30) Foreign Application Priority Data

Jun. 23, 2010 (JP) ..... 2010-142414
May 18, 2011 (JP) ..... 2011-111250

(51) Int. Cl.

| | |
|---|---|
| ***E03C 1/08*** | (2006.01) |
| ***A61H 9/00*** | (2006.01) |
| ***A61H 33/02*** | (2006.01) |
| ***B05B 1/18*** | (2006.01) |
| ***B05B 7/04*** | (2006.01) |
| ***B05B 7/08*** | (2006.01) |
| ***A61H 33/00*** | (2006.01) |

(52) U.S. Cl.

CPC ..... *A61H 9/0021* (2013.01); *A61H 33/027* (2013.01); *B05B 1/18* (2013.01); *B05B 7/0425* (2013.01); *B05B 7/0892* (2013.01); *A61H 33/6052* (2013.01); *A61H 33/6057* (2013.01); *A61H 9/0007* (2013.01); *A61H 2033/022* (2013.01)

USPC ..... 239/428.5; 239/419.5

(58) Field of Classification Search

CPC ..... B05B 7/005; B05B 7/0869

USPC ..... 239/428.5, 344, 354, 419.5

See application file for complete search history.

(56) References Cited

U.S. PATENT DOCUMENTS

| | | | | |
|---|---|---|---|---|
| 4,456,174 | A * | 6/1984 | Neenan | 239/8 |
| 5,215,258 | A * | 6/1993 | Jursich | 239/394 |
| 5,316,216 | A | 5/1994 | Cammack et al. | |
| 5,381,957 | A * | 1/1995 | Bianco | 239/99 |
| 5,507,436 | A * | 4/1996 | Ruttenberg | 239/1 |
| 5,526,540 | A | 6/1996 | Johnson | |
| 2006/0163391 | A1 | 7/2006 | Schorn | |
| 2012/0234943 | A1 * | 9/2012 | Ukigai et al. | 239/428.5 |

FOREIGN PATENT DOCUMENTS

| | | |
|---|---|---|
| CN | 1093251 A | 10/1994 |
| EP | 0601962 A1 | 6/1994 |

(Continued)

OTHER PUBLICATIONS

The Extended European Search Report dated Sep. 22, 2011; Application No. 1171084.4-2318.

*Primary Examiner* — Davis Hwu
(74) *Attorney, Agent, or Firm* — Studebaker & Brackett PC

(57) ABSTRACT

The present invention provides a shower apparatus which allows a user to enjoy spray of water with a voluminous feel even when a small volume of water is discharged as well as with a comfortable stimulus sensation of an instantaneous flow rate of the spray varying greatly. The shower apparatus periodically varies a volume of air taken into an aeration unit by periodically changing a traveling direction of a water stream ejected to the aeration unit from a throttle unit and produces pulsating spray by varying the instantaneous flow rate of bubbly water discharged from a nozzle unit.

11 Claims, 16 Drawing Sheets

(56) References Cited

FOREIGN PATENT DOCUMENTS

| | | | |
|---|---|---|---|
| EP | 2 361 688 | A1 | 8/2011 |
| JP | 3747323 | B1 | 2/2006 |
| JP | 2006-509629 | A | 3/2006 |
| JP | 2008-237601 | A | 10/2008 |

* cited by examiner

43
WFA
421
SA
AFA
431a
AWA

43
WFB
421
SB
AFB
431a
AWB

43
WFC
421
SC
AFC
431a
AWC

43
WFD
421
SD
AFD
431a

WATER DISCHARGE APPARATUS

CROSS-REFERENCES TO RELATED APPLICATIONS

The present application, claims priority to prior filed Japanese Patent applications No. 2010-142414 filed on Jun. 23, 2010 and No. 2011-111250, filed on May 18, 2011, the entire contents of which are hereby incorporated by reference.

BACKGROUND OF THE INVENTION

1. Field of the Invention

The present invention relates to a water discharge apparatus adapted to discharge aerated bubbly water.

2. Description of the Related Art

Known examples of water discharge apparatuses include one which discharges bubbly water by aerating water using a so-called ejector effect. When the water discharge apparatus is configured as a shower apparatus which distributes the water flowing into the apparatus to multiple nozzle holes and sprays water therefrom, in order to aerate the discharged water, the water flowing into the apparatus is aerated before being distributed among the nozzle holes.

An example of such a shower apparatus is proposed in National Publication of International Patent Application No. 2006-509629. The shower apparatus described in National Publication of International Patent Application No. 2006-509629 comprises a plurality of nozzle holes provided in a front face of a disk-shaped housing shell and is configured to discharge water flowing in through the center of a rear face of the housing shell by distributing the water to the plurality of nozzle holes. Furthermore, the shower apparatus produces bubbly water by aerating the water which has flowed into the housing shell and distributes the bubbly water to the plurality of nozzle holes formed so as to distribute the bubbly water over the entire front face of the disk-shaped housing shell. Therefore, a turbulence generation/expansion unit is placed in a traveling direction of the bubbly water, causing the bubbly water to change direction by colliding with the turbulence generation/expansion unit and thereby spread over the entire front face of the housing shell.

Another example of a shower apparatus is proposed in Japanese Patent No. 3747323. With the shower apparatus described in Japanese Patent No. 3747323, when a cock such as a hot and cold mixer tap is opened, water is supplied from a hose and passed through an orifice member. Then, the water is mixed with air sucked through an inner suction port open to a decompression chamber installed on a downstream side of the orifice member and maintained under reduced pressure at the given moment. The shower apparatus described in Japanese Patent No. 3747323 produces bubbly water in this way and discharges the bubbly water through a plurality of nozzle holes provided in a shower head. With the shower apparatus, the produced bubbly water proceeds to the nozzle holes by changing direction by hitting a threaded member in a partitioned pipe installed on the downstream side of the decompression chamber as well as inner walls of the shower head installed further downstream.

Furthermore, from the viewpoint of shower apparatus adapted to discharge bubbly water, a shower apparatus is proposed in Japanese Patent Laid-Open No. 2008-237601. The shower apparatus described in Japanese Patent Laid-Open No. 2008-237601 includes a fine-bubble generator equipped with a gas mixing unit for mixing gas in a water supply line through which shower water flows and adapted to break up the gas mixed in the shower water by the gas mixing unit into fine bubbles and put fine bubbles with bubble diameters of 0.1 to 1000 μm into the shower water discharged from a shower water discharge unit installed at an outlet of the water supply line. The gas mixing unit is provided with gas mixing rate control means adapted to control a mixing rate of the shower water and a gas flow control valve of the gas mixing rate control means is installed in a gas supply channel, where the gas flow control valve is a solenoid valve. The gas flow control valve has its opening controlled by being connected to a control unit adapted to control operation of the shower apparatus. That is, opening control of the gas flow control valve adjusts the channel diameter of the gas supply channel and thereby makes the flow rate of the gas flowing through the gas supply channel variable.

The shower apparatus described in Japanese Patent No. 3747323 is intended to achieve the sensation of water hitting the user intermittently as described in paragraph 0015 of Japanese Patent No. 3747323. The term "intermittently" means that finely divided water droplets of nonuniform sizes hit the user. It is considered that the term expresses a mixed sensation of intermittent strong and weak showers which can be experienced by the user if hit by large-size water droplets which produce a sensation of a strong shower and small-size water droplets which produce a sensation of a weak shower. According to concrete studies conducted by the present inventors, it is presumed that in the bubbly water just produced, water is mixed substantially uniformly with air. Then, the bubbles collide with each other as the produced bubbly water changes direction by hitting the threaded member and the inner walls of the shower head, and it is considered that bubble diameters are nonuniform when the bubbly water reaches the nozzle hoses. Consequently, when discharged from the nozzle holes, the bubbly water turns into water droplets of nonuniform sizes, which are considered to achieve the sensation described above when directed at the user.

On the other hand, National Publication of International Patent Application No. 2006-509629 does not give any description of properties of the bubbly water discharged from the shower apparatus described in National Publication of International Patent Application No. 2006-509629. However, it is presumed that the shower apparatus produces water droplets of nonuniform sizes by supplying and discharging bubbly water with nonuniform bubble diameters from the nozzle holes and directs the water droplets of nonuniform sizes at the user, as in the case of the shower apparatus described in Japanese Patent No. 3747323. This is because since in the shower apparatus described in National Publication of International Patent Application No. 2006-509629, the turbulence generation/expansion unit is placed in the traveling direction of the bubbly water, causing the bubbly water to change direction by colliding with the turbulence generation/expansion unit, it is considered that similar nonuniform bubble growth takes place in the shower apparatus described in Japanese Patent No. 3747323 and that resulting water droplets of nonuniform sizes are directed at the user. Since both the shower apparatus described in National Publication of International Patent Application No. 2006-509629 and shower apparatus described in Japanese Patent No. 3747323 throw water droplets of nonuniform sizes at the user using bubbly water containing nonuniform bubbles, they produce only a small difference between sensations of strong and weak showers, and consequently a sufficient stimulus sensation is not available.

On the other hand, in the shower apparatus described in Japanese Patent Laid-Open No. 2008-237601, the solenoid valve acting as the gas flow control valve of the gas mixing rate control means is installed in the gas supply channel.

Although the gas mixing rate control means allows intentional control of the bubble content, a solenoid valve acting as the gas flow control valve becomes necessary. Thus, although the shower apparatus described in Japanese Patent Laid-Open No. 2008-237601 may be able to discharge bubbly water with a stimulus sensation, means of physically operating a structure such as the solenoid valve is required, resulting in a water discharge apparatus which runs counter to size and cost reductions.

Under these circumstances, the present thought of providing a water discharge apparatus which provides a voluminous feel even when discharging a small volume of water, causes an instantaneous flow rate of spray to change greatly, allows water to be discharged with a comfortable stimulus sensation, and lends itself to size and cost reductions, where the water discharge apparatus may be not only a shower apparatus, but also a sanitary cleansing apparatus which discharges water through a single orifice. In contrast, the conventional techniques, which achieve the sensation of nonuniformly-sized water droplets hitting the user as described above, do not provide spray of a shower with a comfortable stimulus sensation of the instantaneous flow rate of the spray varying greatly as well as with a voluminous feel. Besides, the conventional techniques are not able to provide spray of a shower with a comfortable stimulus sensation of the instantaneous flow rate of the spray varying greatly as well as with a voluminous feel while achieving size and cost reductions.

SUMMARY OF THE INVENTION

The present invention has been made in view of the above problem and has an object to provide a water discharge apparatus which allows a user to enjoy spray of water with a voluminous feel even when a small volume of water is discharged as well as with a comfortable stimulus sensation of an instantaneous flow rate of spray varying greatly.

To solve the above problem, the present invention provides a water discharge apparatus for discharging aerated bubbly water, comprising: a water supply unit adapted to supply water; a throttle unit installed downstream of the water supply unit and adapted to make a cross sectional area of a flow channel smaller than the water supply unit and thereby eject passing water downstream at increased flow velocity; an aeration unit installed downstream of the throttle unit and provided with an opening adapted to produce the bubbly water by aerating a water stream ejected through the throttle unit; and a water discharge unit adapted to discharge the bubbly water generated by the aeration unit. The water discharge apparatus according to the present invention further comprises pulsation means adapted to periodically vary a volume of air taken into the aeration unit by periodically changing a traveling direction of the water stream ejected to the aeration unit from the throttle unit and produce pulsating spray by varying an instantaneous flow rate of the bubbly water discharged from the water discharge unit.

According to the present invention, since the aeration unit produces the bubbly water by aerating the water stream ejected from the throttle unit and the bubbly water is discharged from the water discharge unit, the user can enjoy spray of water with a voluminous feel. Furthermore, since the water discharge apparatus is equipped with the pulsation mechanism adapted to produce pulsating spray by greatly varying an instantaneous flow rate of the bubbly water discharged from the water discharge unit, the user can enjoy spray of water with a comfortable stimulus sensation of an instantaneous flow rate of the spray varying greatly. When the pulsation mechanism produces the pulsating spray, the volume of air taken into the aeration unit is varied by periodically changing the traveling direction of the water stream ejected from the throttle unit. Specifically, the traveling direction of the water stream ejected from the throttle unit is periodically changed by periodically changing the traveling direction of the water stream after the water stream is ejected from the throttle unit or periodically changing an ejection direction itself from the throttle unit. Since the pulsation mechanism periodically varies the volume of air taken into the aeration unit by periodically changing the traveling direction of the water stream and furthermore produces the pulsating spray using the variation in the volume of air, the pulsating spray can be produced as a result of simply changing the traveling direction of the water stream. Thus, a simple configuration conducive to cost and size reductions ensures design aesthetics and reliability of the water discharge apparatus and implements a water discharge apparatus which allows a user to enjoy pulsating spray with a voluminous feel even when a small volume of water is discharged as well as with a comfortable stimulus sensation of the instantaneous flow rate of the spray varying greatly.

Also, in the water discharge apparatus according to the present invention, preferably the pulsation mechanism periodically changes the traveling direction of the water stream ejected to the aeration unit from the throttle unit, thereby varies en amount of negative suction pressure of air in the aeration unit, and thereby varies the volume of air taken into the aeration unit.

According to this preferred aspect, the pulsation mechanism periodically changes the traveling direction of the water stream, varies the amount of negative suction pressure of air in the aeration unit using the periodic changes, and thereby varies the force of drawing air into the aeration unit. Consequently, the volume of air taken into the aeration unit can be varied reliably by simply varying the amount of negative suction pressure used to suck air into the aeration unit. Thus, without using a special means of varying air sent into the aeration unit, a simple configuration conducive to further cost and size reductions makes it possible to realize pulsating spray with a comfortable stimulus sensation of the instantaneous flow rate of the spray varying greatly in a reliable manner.

Also, in the water discharge apparatus according to the present invention, preferably an air-liquid interface which is a boundary between water and air is formed downstream of the opening within the aeration unit and an air intake area is formed in part of the air-liquid interface to tear off air flowing in through the opening and take the air into the water stream; and the pulsation mechanism varies the amount of negative suction pressure of air in the aeration unit by changing a distance from the opening to the air intake area and thereby varies the volume of air taken into the aeration unit.

According to this preferred aspect, by changing the distance from the opening to the air intake area, the pulsation mechanism can maintain the volume of air taken in through the opening at a sufficient level or decrease the volume of air taken in through the opening. Specifically, by changing the distance from the opening to the air intake area, this configuration changes an acceleration distance for accelerating the air by running from the opening to the air intake area and thereby changes the flow velocity of the air plunging into the air intake area. If the flow velocity of the air plunging into the air intake area increases, an amount of air inclusion in the air intake area increases, increasing the amount of negative suction pressure in the aeration unit. On the other hand, if the flow velocity of the air plunging into the air intake area decreases, the amount of air inclusion in the air intake area decreases, decreasing the amount of negative suction pressure in the aeration unit. Thus, by changing the distance from the opening to the air intake area, the amount of negative suction pressure of air in the aeration unit can be varied reliably. In this way, by simply changing the distance from the opening to the air intake area and thereby varying the amount of negative suction pressure of air, the volume of air intake can be varied reliably, making it possible to realize pulsating spray with a comfortable stimulus sensation of the instantaneous flow rate of spray varying greatly in a reliable manner.

Also, in the water discharge apparatus according to the present invention, preferably the pulsation mechanism forms the air intake area by causing the water stream ejected to the aeration unit from the throttle unit to collide with a wall surface facing an air side of the air-liquid interface within the aeration unit and changes the distance from the opening to the air intake area by changing a location of the collision.

The water discharge apparatus according to the present invention allows the user to have a comfortable stimulus sensation, by greatly varying the instantaneous flow rate of spray. To achieve the comfortable stimulus sensation, the amount of negative suction pressure of air in the aeration unit is varied, thereby reliably varying the volume of air taken into the aeration unit. In order for the user to have a comfortable stimulus sensation, it is necessary to reduce a period of pulsating spray. This is because if the period of pulsating spray increases, intervals of changes in the volume of water hitting the user increases as well, making it difficult for the user to have a stimulus sensation. Thus, according to this preferred aspect, in order to reduce variation periods of both the amount of negative suction pressure and volume of air intake, the air intake area is formed by causing the water stream to collide with that wall surface of the aeration unit which is located on the side on which air exists and the distance from the opening to the air intake area is changed by changing the location of the collision. Since the air intake area is formed in part of the air-liquid interface, it is conceivable to change the acceleration distance of air by changing the distance between the entire air-liquid interface and the opening.

However, the air-liquid interface is generated by balance between internal pressure of water temporarily pooled in the aeration unit and negative pressure drawing air into the aeration unit, and the location of the air-liquid interface coincides with the location where the internal pressure of water and negative pressure of air become balanced. Therefore, to change the distance between the air-liquid interface and opening, it is necessary to change the balance between the internal pressure of water and, negative pressure of air, but the distance cannot be varied, for example, by just slightly changing the traveling direction of the water stream ejected from the throttle unit. Thus, according to this preferred aspect, the air intake area is formed forcibly by causing the water stream to collide with the wall surface facing the air side of the air-liquid interface within the aeration unit, and the location of the air intake area is varied by adjusting the traveling direction of the water stream instead of manipulating pressure balance. In this way, the location of collision between the water stream and wall surface is moved reliably by changing the traveling direction of the water stream and the distance from the opening to the air intake area is changed reliably.

Also, in the water discharge apparatus according to the present invention, preferably when periodically changing the traveling direction of the water stream ejected to the aeration unit from the throttle unit, the pulsation mechanism temporarily changes the traveling direction to avoid collision with the wall surface of the aeration unit.

As described above, the location of the air-liquid interface coincides with the location where the internal pressure of the water temporarily pooled in the aeration unit and the negative pressure drawing air into the aeration unit become balanced. On the other hand, the air intake area, which is part of the air-liquid interface and is formed by causing the water stream to collide with the wall surface, is formed by pulling out part of the air-liquid interface toward the opening side. Thus, according to this preferred aspect, when the traveling direction of the water stream ejected to the aeration unit from the throttle unit is periodically changed, the traveling direction is temporarily changed to avoid collision with the wall surface, and consequently the location of the air intake area is pulled away to the location where the internal pressure of water and negative pressure of air become balanced. This increases the distance between the aeration unit and opening, maximizing the volume of air taken into the aeration unit.

Also, in the water discharge apparatus according to the present invention, preferably when periodically changing the traveling direction of the water stream ejected to the aeration unit from the throttle unit, the pulsation mechanism changes the traveling direction of the water stream so as to cause a collision at a location close to a downstream side of the opening in the aeration unit.

As described above, according to a preferred aspect of the present invention, the volume of air taken in through the opening is maintained at a sufficient level or the volume of air taken in through the opening is decreased by varying the location of the air intake area. According to this preferred aspect, to greatly vary the volume of air taken in through the opening, the traveling direction of the water stream ejected from the throttle unit is changed so as to cause a collision at a location close to the downstream side of the opening in the aeration unit. In this way, by changing the traveling direction of the water stream, this configuration moves the location of the air intake area toward the opening side, thereby minimizes the volume of air taken into the aeration unit, and thereby maximizes the variation in the volume of air intake. Thus, the volume of air intake can be varied greatly in a reliable manner, making it possible to realize pulsating spray with a comfortable stimulus sensation of the instantaneous flow rate of the spray varying greatly in a reliable manner.

Also, in the water discharge apparatus according to the present invention, preferably when periodically changing the traveling direction of the water stream ejected from the throttle unit, the pulsation mechanism changes the traveling direction of the water stream without interfering with the opening, and thereby prevents water from flowing out of the opening.

Since the opening in the water discharge apparatus according to the present invention is intended to take air into the aeration unit, any outflow of water through the opening is an unintended water discharge and is not only undesirable, but also can clog the opening with a calcium component in the water adhering to the inside of the opening. Thus, according to this preferred aspect, the traveling direction of the water stream ejected from the throttle unit is changed without interfering with the opening to prevent water from flowing out of the opening.

Also, in the water discharge apparatus according to the present invention, preferably the pulsation mechanism causes the water stream ejected to the aeration unit from the throttle unit to be separated from a wall surface of the throttle unit, forms a negative interflow pressure portion between the water stream and the wall surface by means of the flow separation, and thereby periodically changes the traveling direction of the water stream.

According to this preferred aspect, since the water stream ejected from the throttle unit is separated from the wall surface of the throttle unit and the negative interflow pressure portion is formed between the water stream and the wall surface by means of the flow separation, the traveling direction of the water stream ejected from the throttle unit can be changed periodically by the action of the negative interflow pressure portion. In this way, since the traveling direction of the water stream is changed periodically by simply separating the water stream from the wall surface and thereby forming the negative interflow pressure portion, the volume of air intake can be varied using an extremely simple configuration. Thus, without using a special means of periodically changing the traveling direction of the water stream, a simple configuration conducive to further cost and size reductions makes it possible to realize pulsating spray with a comfortable stimulus sensation of the instantaneous flow rate of the spray varying greatly in a reliable manner.

Also, in the water discharge apparatus according to the present invention, preferably the opening is formed only on a side opposite to the negative interflow pressure portion formed by the pulsation mechanism, to prevent the air sucked through the opening from entering the negative interflow pressure portion.

According to this preferred aspect, the opening is formed only on a side opposite to the negative interflow pressure portion to prevent the air sucked through the opening from entering the negative interflow pressure portion. In this way, an arrangement of the opening and negative interflow pressure portion can be devised so as to generate negative pressure easily without mixing air the negative interflow pressure portion and thereby ensure that necessary negative pressure will be available.

Also, in the water discharge apparatus according to the present invention, preferably a throttle channel which is flat-shaped relative to the ejection direction of the water stream is formed in the throttle unit to cause the water stream ejected to the aeration unit to become a sheet-like stream of water; and the sheet-like stream of water ejected to the aeration unit from the throttle unit is configured to prevent the air sucked through the opening from entering the negative interflow pressure portion.

According to this preferred aspect, since the flat throttle channel is formed in the throttle unit, the water stream ejected from the throttle channel becomes a sheet like stream ref water. Thus, since the sheet-like stream of water can be interposed between the opening and negative interflow pressure portion, the air taken in through the opening cannot reach the negative interflow pressure portion by being interrupted by the sheet-like stream of water. In this way, by simply making cross-sectional shape of the throttle channel flat, it is possible to generate negative pressure easily without mixing air into the negative interflow pressure portion and thereby ensure that necessary negative pressure will be available.

Also, in the water discharge apparatus according to the present invention, preferably the pulsation mechanism periodically changes the traveling direction of the water stream ejected from the throttle unit, using a pressure difference between the negative suction pressure generated to suck air into the aeration unit through the opening and the negative interflow pressure, increasing the negative interflow pressure when the negative suction pressure decreases, and decreasing the negative interflow pressure when the negative suction pressure increases.

According to this preferred aspect, the negative suction pressure and negative interflow pressure can be caused to exert a greater force alternately on the water stream ejected from the throttle unit. Forces are exerted on the water stream by increasing the negative interflow pressure when the negative suction pressure is decreased, and decreasing the negative interflow pressure when the negative suction pressure is increased. This reliably prevents the negative suction pressure and negative interflow pressure from coming into balance and stopping periodic variation in the traveling direction of the water stream.

The present invention provides a water discharge apparatus which allows a user to enjoy spray of water with a voluminous feel even when a small volume of water is discharged as well as with a comfortable stimulus sensation of an instantaneous flow rate of the spray varying greatly.

BRIEF DESCRIPTION OF THE DRAWINGS

FIG. 1A is a plan view, FIG. 1C is a bottom view;

FIG. 12A is a plan view, FIG. 12B is a side view, and FIG. 12C is a bottom view;

FIG. 15 is an enlarged view showing part D in FIG. 13; and

DETAILED DESCRIPTION OF THE PREFERRED EMBODIMENTS

Figure 1A:
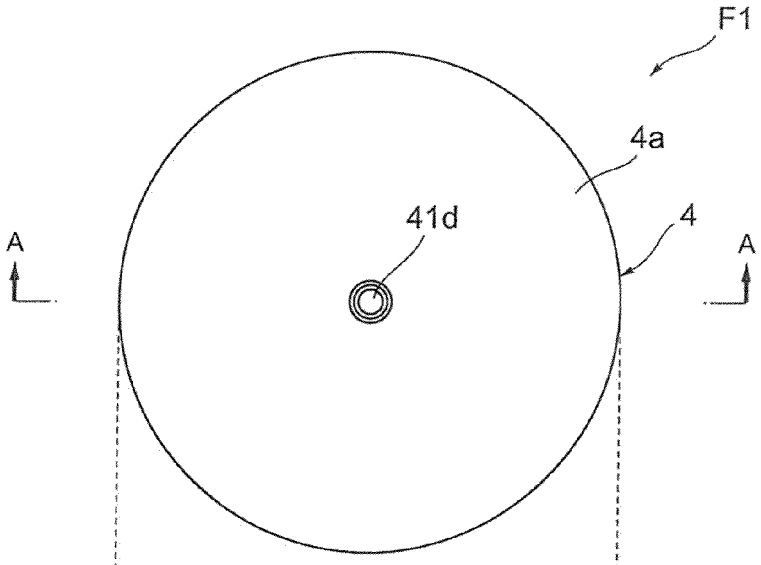
FIGS. 1A to 1C are diagrams showing a shower apparatus according to a first embodiment of the present invention, where

Embodiments of the present invention will be described below with reference to the accompanying drawings. To facilitate understanding of the description the same components in different drawings are denoted by the same reference numerals whenever possible and redundant description thereof will be omitted.

Figure 1B:
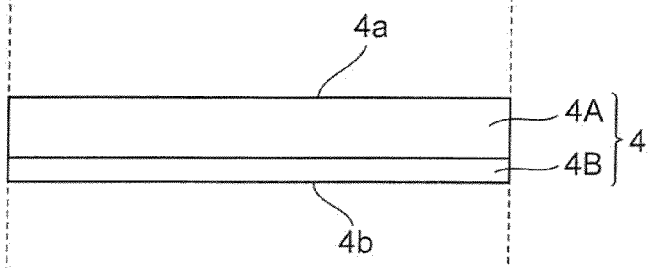
Figure 1C:
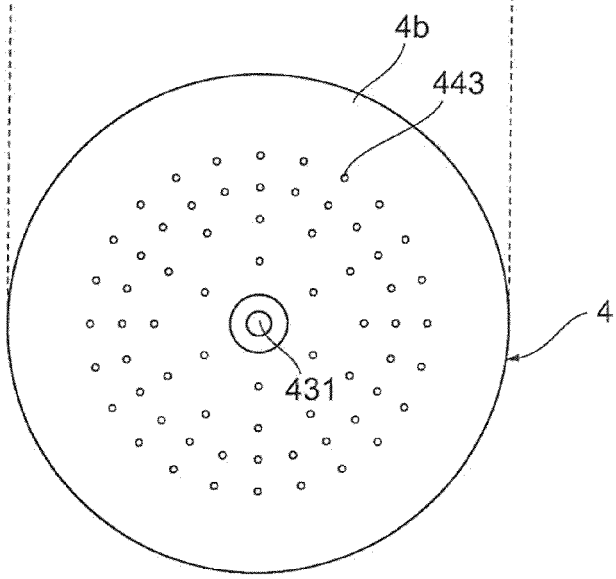

A shower apparatus which is a first embodiment of the present invention will be described with reference to FIGS. 1A to 1C, which are diagrams showing the shower apparatus according to the first embodiment of the present invention, where FIG. 1A is a plan view, FIG. 1B is a side view, and FIG. 1C is a bottom view. As shown in FIG. 1A, the shower apparatus F1 mainly includes a body 4 shaped approximately like a disk, and a water supply port 41*d* is formed in a top face 4*a* of the shower apparatus F1 (body 4).

As shown in FIG. 4B, the body 4 of the shower apparatus F1 has its external shape formed by a cavity 4A in which the water supply port 41*d* is formed and a shower plate 4B in which nozzle holes 443 are formed. As shown in FIG. 1C, an opening 431 as well as a plurality of nozzle holes 443 are formed in a bottom face 4*b* of the body 4. According to the present embodiment, the nozzle holes 443 are arranged radially around the opening 431.

Figure 2:
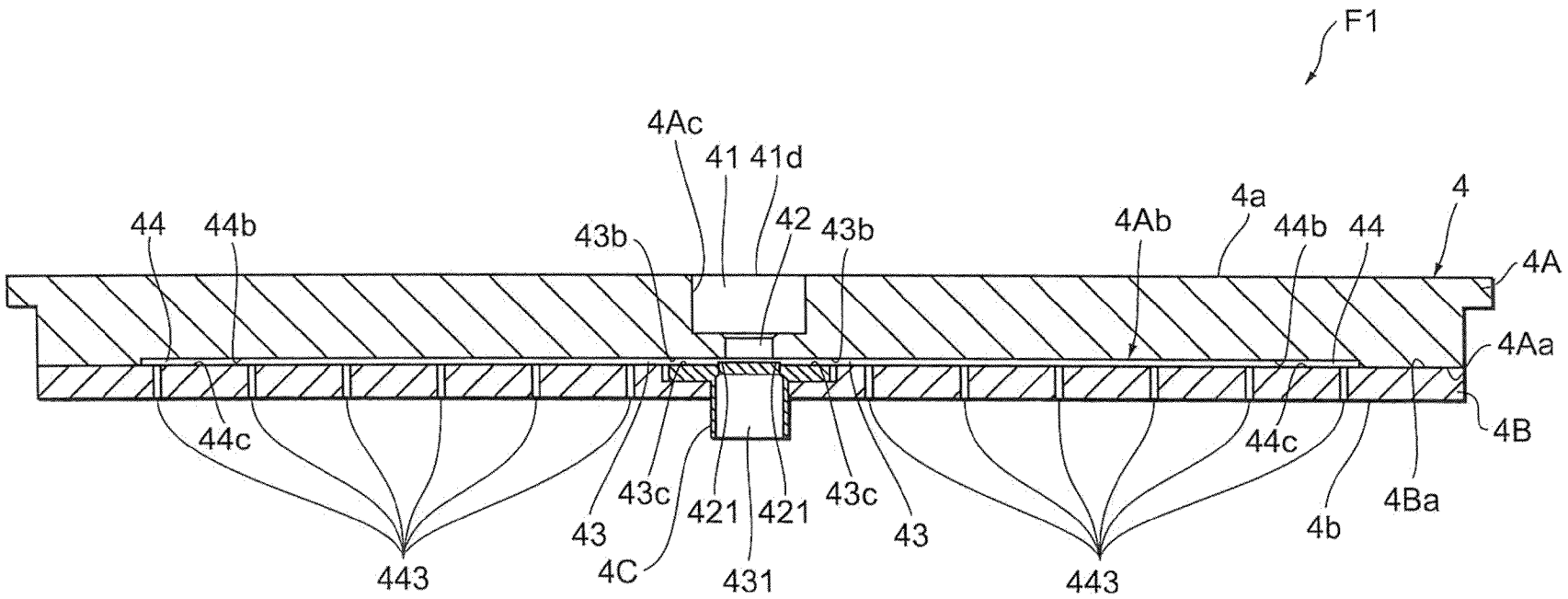
FIG. 2 is a sectional view taken along line A-A in FIG. 1A.

Next, the shower apparatus F1 will be described with reference to FIG. 2, which is a sectional view taken along line A-A in FIG. 1A. As shown in FIG. 1, the shower apparatus F1 includes the cavity 4A, the shower plate 4B, and a water ejection piece 4C.

The cavity 4A is a member which forms the external shape of the body 4 in conjunction with the shower plate 4B. In the cavity 4A, a concave portion 4Ab circular in shape is formed extending from an abutting face 4Aa opposite the top face 4*a* of the body 4 toward the top face 4*a*. Near the center of the cavity 4A, a through-hole 4Ac is formed, running from the top face 4*a* to the concave portion 4Ab. As the through-hole 4Ac is provided in this way, a water supply unit 41 is formed, extending from the water supply port 41*d* to a throttle unit 42.

The shower plate 4B is a member which forms the external shape of the body 4 in conjunction with the cavity 4A, and a plurality of the nozzle holes 443 are arranged radially in the shower plate 43. In the region in which the nozzle holes 443 are formed, an abutting face 43*a* is formed, opposing the bottom face 4*b* and making up a side wall 44*c* of a nozzle unit 44.

When the abutting face 4Ba of the shower plate 43 and the abutting face 4Aa of the cavity 4A are abutted against each other, a vacant space is formed between the abutting faces and the concave portion 4Ab of the cavity 4A, being configured to serve as an aeration unit 43 and nozzle unit 44. Part of the concave portion 4Ab is configured to serve as a side wall 44*a* of the nozzle unit 44.

Figure 3:
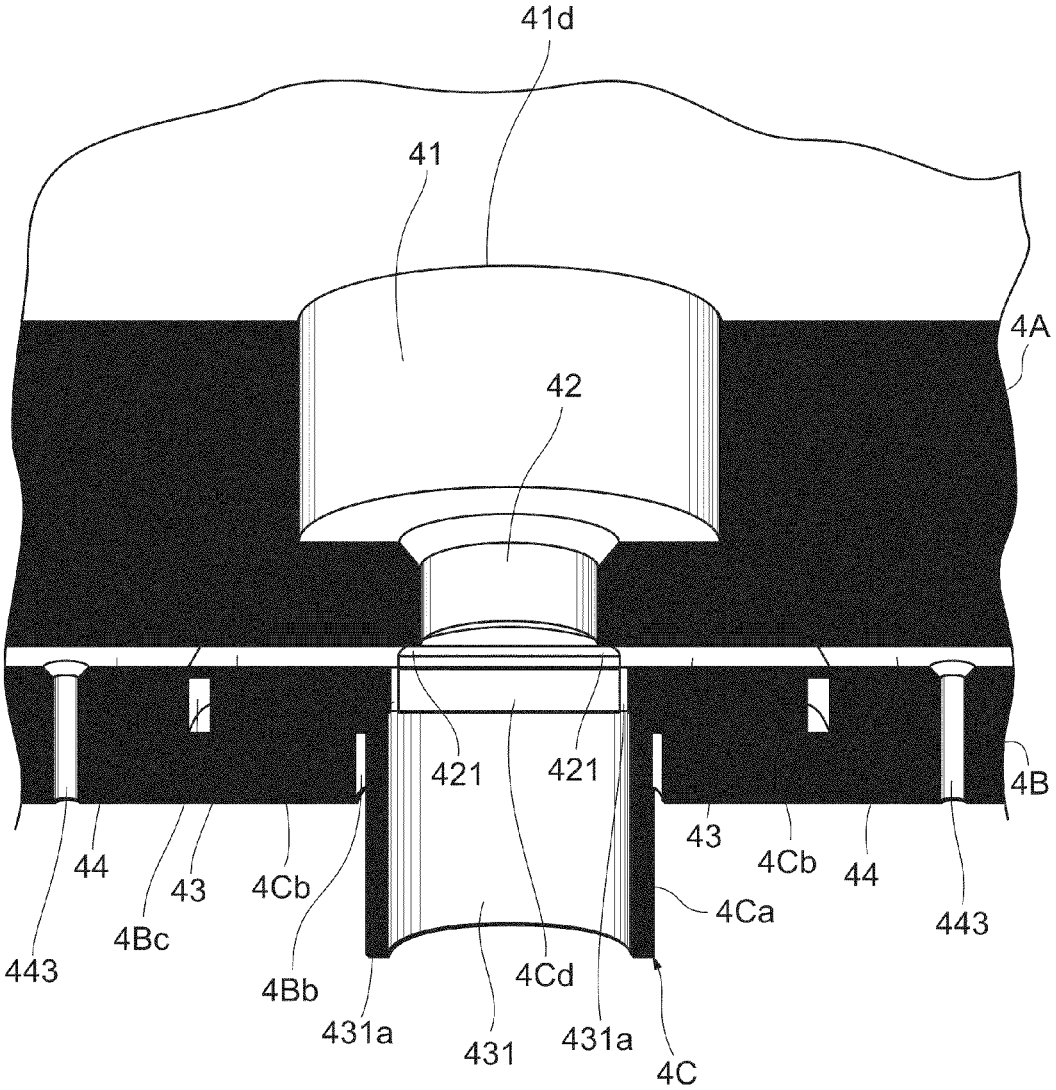
FIG. 3 is an enlarged perspective sectional view magnifying and showing a water ejection piece and its vicinity shown in FIG. 2.
Figure 4:
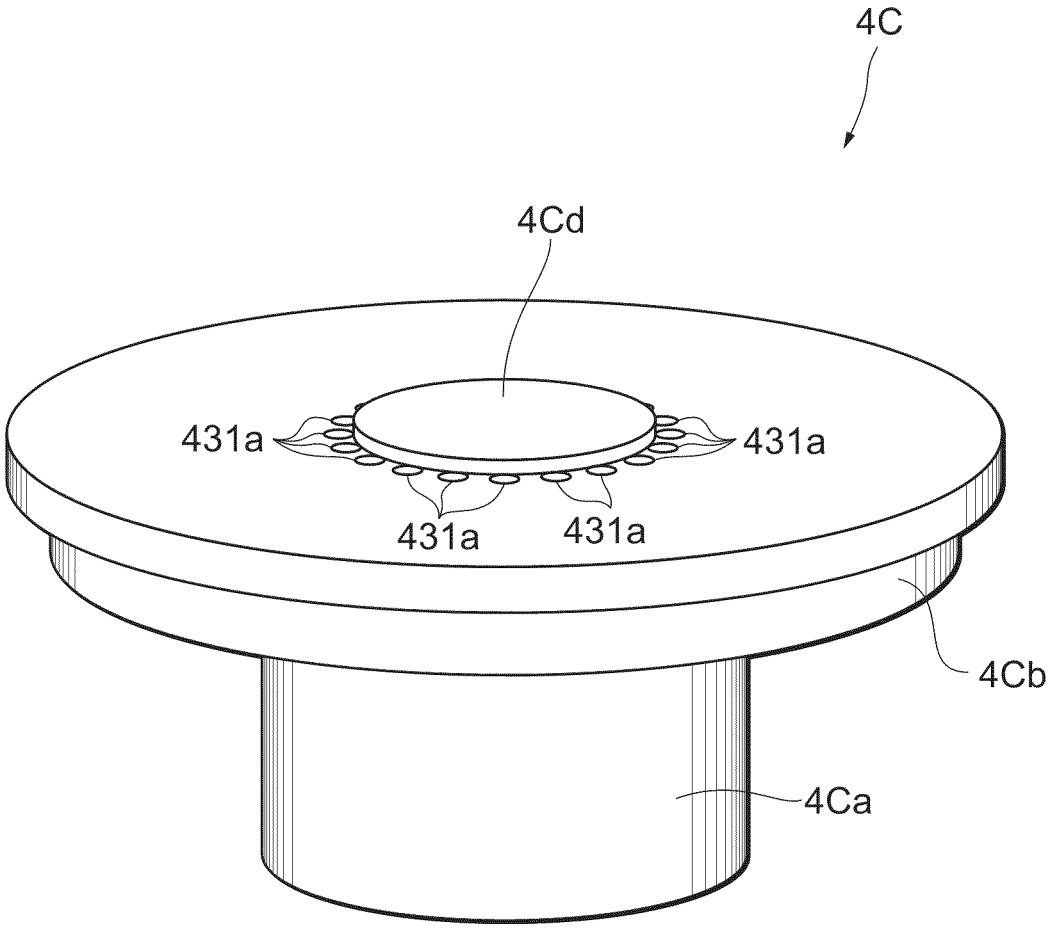
FIG. 4 is a perspective view snowing the water ejection piece shown in FIG. 2.
Figure 5:
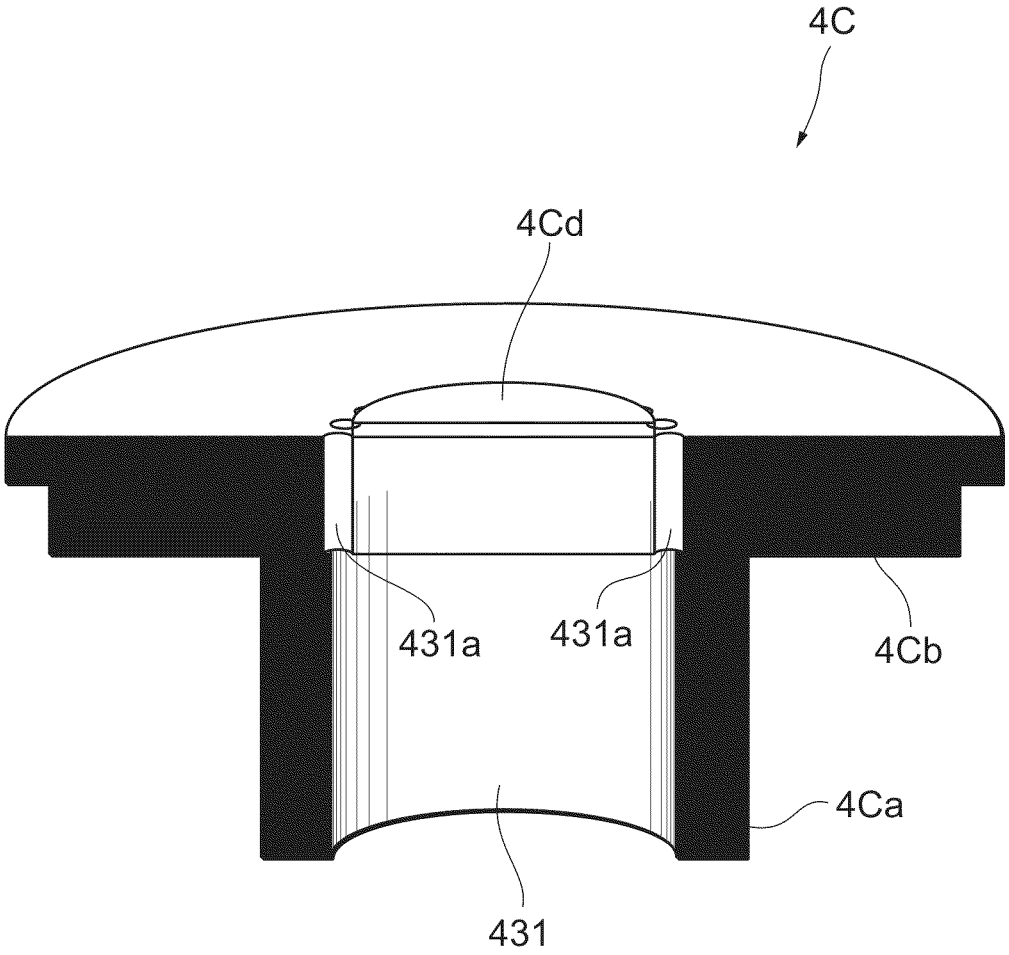
FIG. 5 is a perspective sectional view showing a cross section near the center of the water ejection piece shown in FIG. 4.

Next, the water ejection piece 4C will be described with reference to FIGS. 3 to 5. FIG. 3 is a perspective sectional view magnifying and showing the water ejection piece 4C and its vicinity. FIG. 4 is a perspective view showing the water ejection piece 4C. FIG. 5 is a perspective sectional view showing a cross section near the center of the water ejection piece 4C shown in FIG. 4. As shown in FIGS. 3 to 5, the water ejection piece 4C, with its flange 4Cb corresponding to a brim, is shaped like a hat. Also, an air introducing projection 4Ca is formed at that end of the water ejection piece 4C which, being located opposite the flange 4Cb, corresponds to a top of the hat shape. Also, a throttle projection 40*d* is formed near the center of the flange 4Cb, i.e., on the side opposite the air introducing projection 4Ca.

The throttle projection 4Cd, which forms part of the throttle unit 42, forms a throttle channel 421 by opposing the cavity 4A. Therefore, the throttle channel 421 forms a slit all around the cavity 4A so as to eject a radial film of water from near the center of the cavity 4A.

A plurality of air introduction holes 431*a* are formed all around the throttle projection 40*d*. The air introduction holes 431*a* are intended to supply air to the throttle channel 421 and communicated with the opening 431 formed in the air introducing projection 4Ca.

In the shower plate 4B a concave portion 4Bc circular in shape is formed, extending from the abutting face 46*a* opposite the bottom face 4*b* of the body 4 toward the bottom face 4*b*. The concave portion 4Bc is formed in the center of the shower plate 4B, being located inside the nozzle holes 443 provided radially. A through-hole 4Bb is formed in a bottom face of the concave portion 4Bc, running to the bottom face 4*b*. The water ejection piece 4C is housed in the concave portion 4Bc.

The air introducing projection 4Ca of the water ejection piece 4C is placed so as to protrude outward from the through-hole 4Bb. Therefore, the opening 431 formed in the air introducing projection 4Ca is configured to take in outside air.

When the cavity 4A, shower plate 4B, and water ejection piece 4C are assembled together as described above, the shower apparatus F1 is equipped with the water supply unit 41, throttle unit 42, aeration unit 43, and nozzle unit 44.

The water supply unit 41 is a part intended to supply water and adapted to supply water introduced through the water supply port 41*d* to the throttle unit 42. The water supply port 41*d* can be connected with water supply means such as a water supply hose: not shown) and the water supplied through the water supply means is supplied from the water supply unit 41 to the throttle unit 42.

The throttle unit 42 is a part installed downstream of the water supply unit 41 and adapted to make the cross sectional area of a flow channel smaller than the water supply unit 41 and thereby eject passing water downstream. A single throttle channel 421 is installed in the throttle unit 42.

The aeration unit 43 is a part installed downstream of the throttle unit 42 and provided with the opening 431 used to aerate the water ejected through the throttle unit 42 and thereby turn the water into bubbly water.

The nozzle unit 44 is a part installed downstream of the aeration unit 43 and provided with the plurality of nozzle holes 443 used to discharge bubbly water.

Figure 6:
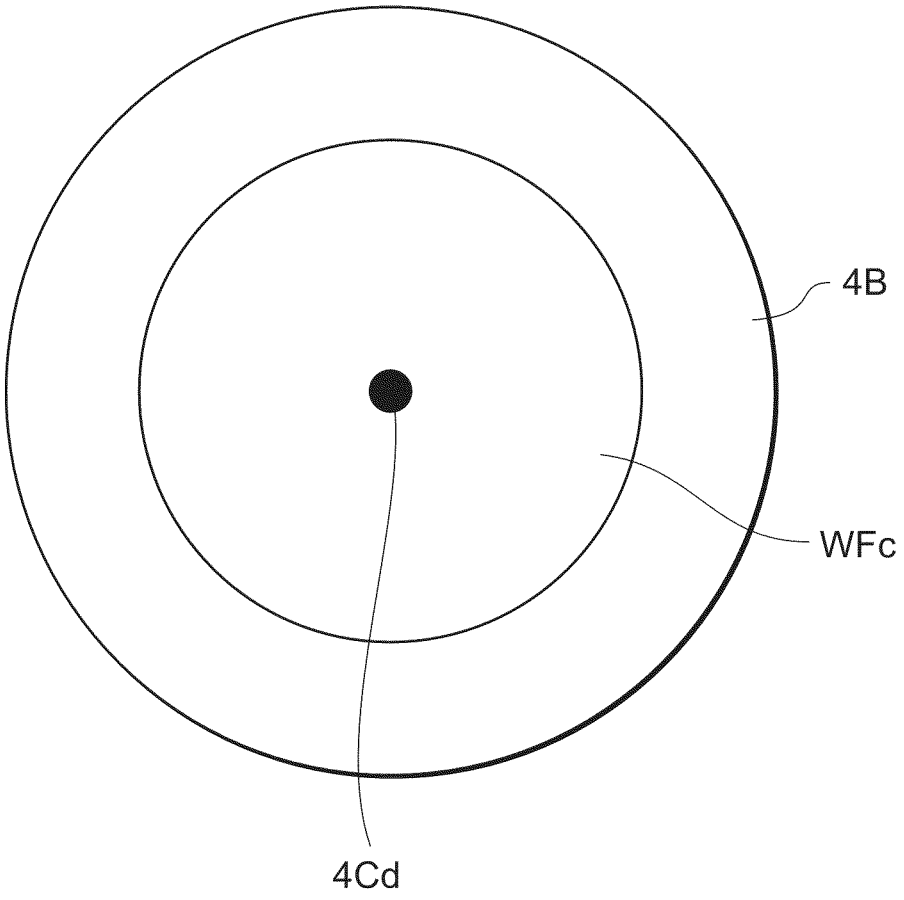
FIG. 6 is a plan view showing how water is ejected when the water ejection piece shown in FIG. 4 is used.

With the shower apparatus F1, when water is supplied from the water supply unit 41, a sheet-like stream WFc is ejected from the throttle channel 421 of the throttle unit 42. FIG. 6 shows how the sheet-like stream WFc is ejected. FIG. 6 is a diagram schematically showing how the sheet-like stream WFc is ejected when the shower apparatus F1 is viewed from the side of the water supply unit 41. As shown in FIG. 6, the sheet-like stream WFc ejected all around.

In this way, when the sheet-like stream WFc is ejected, convection currents which are less prone to collisions with each other are generated on both sides of an entry line along which the sheet-like stream WFc plunges. Convection currents less prone to collisions with each other, when generated in this way, can reduce the possibility of air bubble enlargement due to collisions of air bubbles. If the air bubbles in the bubbly water are broken up into minute bubbles and the flow of bubbly water is made less prone collisions, thereby maintaining the minute bubbles, even if the nozzle holes 443 are placed at locations distant from the throttle channel 421, the air bubbles are supplied to the nozzle holes 443 without being affected by buoyancy. This makes it possible to supply the bubbly water stably through all the nozzle holes 443.

As the bubbly water containing air bubbles of such a substantially uniform diameter is supplied to the nozzle holes 443, a bubble flow or slug flow can be formed in the nozzle holes 443 and just after discharge from the nozzle holes 443. When discharged from the nozzle holes 443, the bubbly water containing air bubbles of such a substantially uniform diameter and formed as a bubble flow or slug flow in this way is finely divided substantially uniformly by being sheared in a direction substantially orthogonal to a discharge direction without being turned into a mist as in the case of an annular flow. This causes water droplets of relatively large, uniform size to land continuously on the user and thereby allows the user to enjoy a shower with a voluminous feel as if the user were showered by large drops of rain.

Figure 7:
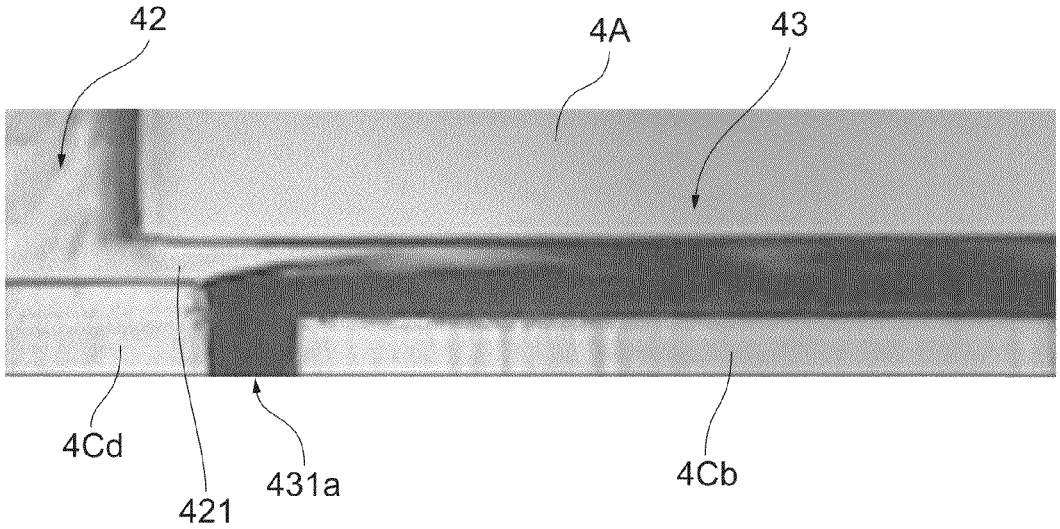
FIG. 7 is a diagram showing a state of water and air in an aeration unit of the shower apparatus according to the first embodiment of the present invention.
Figure 8:
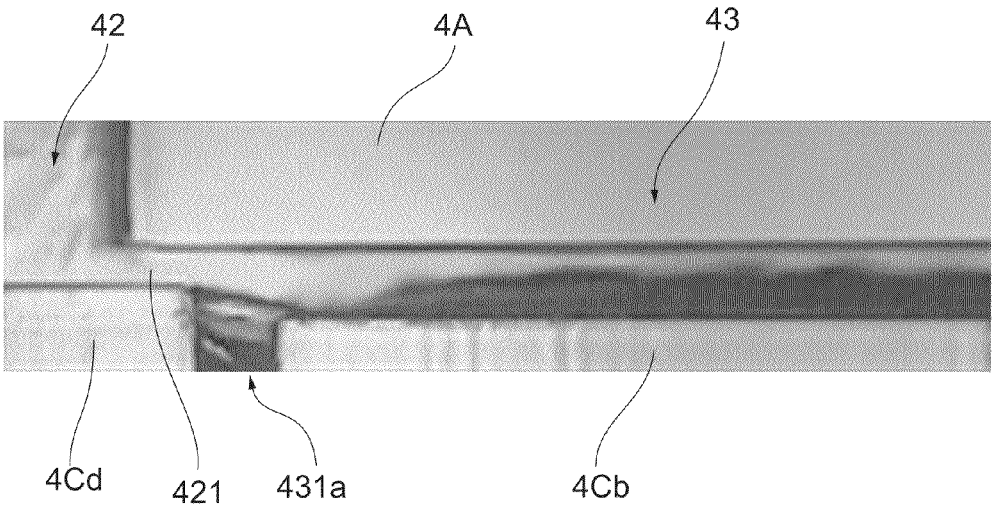
FIG. 8 is a diagram showing a state of water and air in the aeration unit of the shower apparatus according to the first embodiment of the present invention.

Furthermore, the shower apparatus F1 according to the present embodiment realizes pulsating spray with a greatly varying instantaneous flow rate of spray so as to give a comfortable stimulus sensation of the instantaneous flow rate of the spray varying greatly. Variations in a state of water and air in the aeration unit 43 of the shower apparatus F1 are shown in FIGS. 7 and 8. FIGS. 7 and 8 are photographs taken with water passed through the throttle channel 421 and aeration unit 43 of the shower apparatus F1. In FIGS. 7 and 8, water is ejected to the aeration unit 43 from the throttle channel 421, air is sucked through the air introduction holes 431*a*, and the water and air are mixed in the aeration unit 43. In FIGS. 7 and 8, a whitish-looking part is water and dark-looking part is air.

The present inventors have verified that the state shown in FIG. 7 and state shown in FIG. 8 alternate each other periodically. In the state shown in FIG. 7, the water stream ejected from the throttle channel 421 moves straight toward the aeration unit 43. When the water stream is ejected, negative pressure is produced as a result in the aeration unit 43 and air is sucked through the air introduction holes 431*a*. On the other hand, in the state shown in FIG. 8, the water stream ejected from the throttle channel 421 moves toward the aeration unit 43 by being pulled so as to block the air introduction holes 431*a*. The volume of air sucked through the air introduction holes 431*a* as a result of the water stream ejection has been reduced greatly compared to state shown in FIG. 7.

Figure 9:
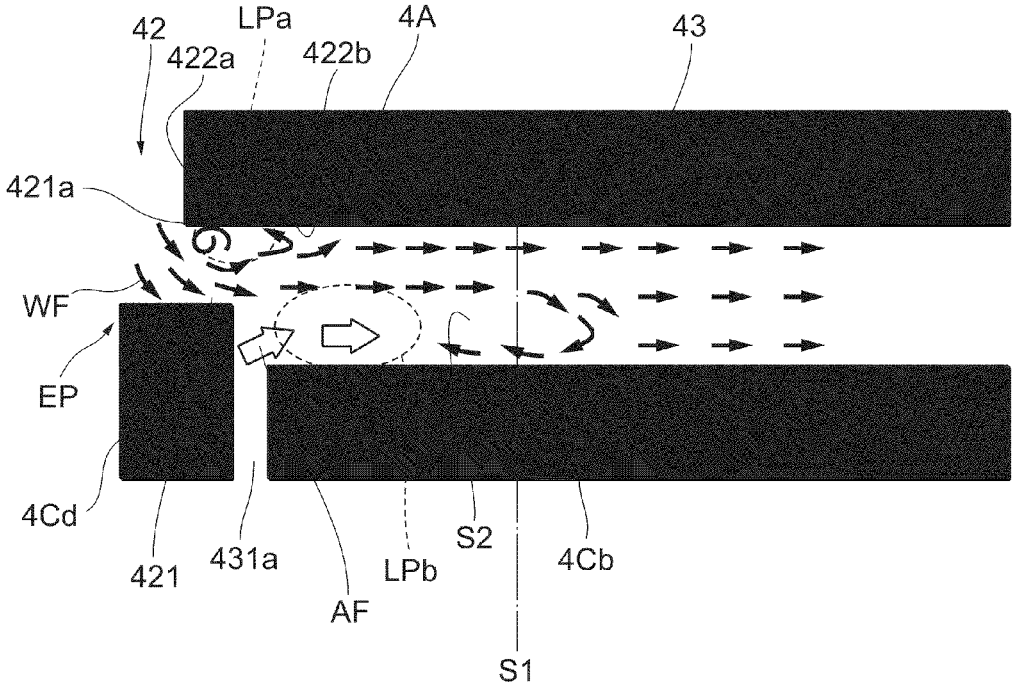
FIG. 9 is a diagram schematically showing the state shown in FIG. 7.
Figure 10:
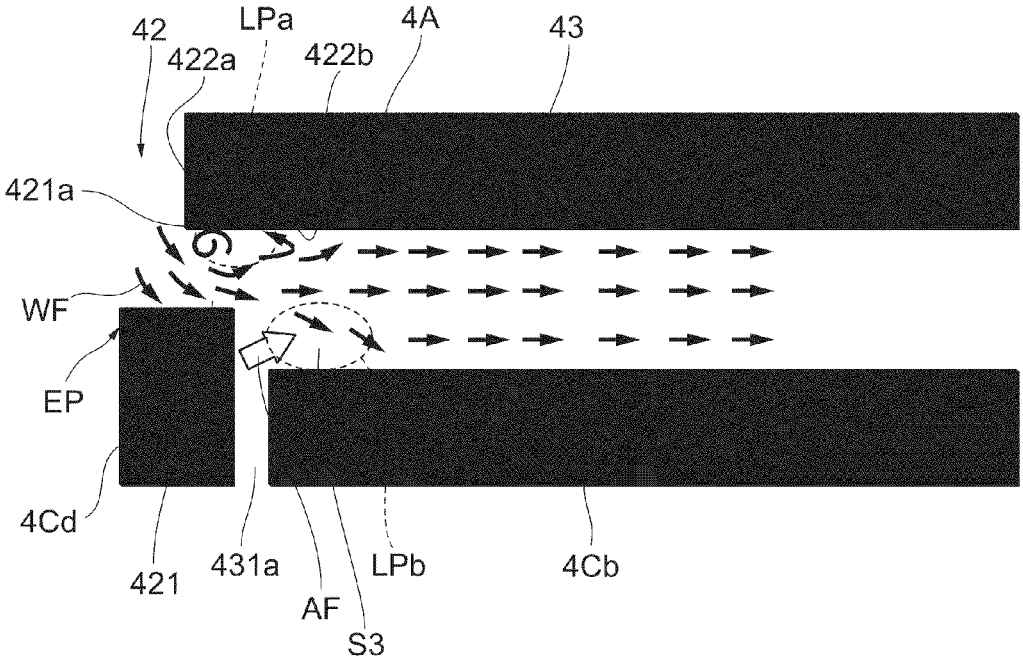
FIG. 10 is a diagram schematically showing the state shown in FIG. 8.

To describe the states in FIGS. 7 and 8 in more detail, the state in FIG. 7 is shown schematically in FIG. 9 and the state in FIG. 8 is shown schematically in FIG. 10. As shown in FIG. 9, a water stream WF flowing in from the upstream side of the throttle unit 42 changes direction by hitting the throttle projection 4Cd and heads toward the throttle channel 421. After having its speed accelerated by the throttle channel 421, the water stream WF is ejected toward the aeration unit 43. When the water stream WF is ejected to the aeration unit 43, water is pooled starting from the downstream side and the water stream WF ejected from the throttle channel 421 plunges into the pooled water. An air-liquid interface is produced between the water pool and air. Standard position of the air-liquid interface is established, for example, at an interface position S1. However, since the air-liquid interface is a place where air is torn off and taken into the water stream WF, the air-liquid interface is an unstable region where a large swell occurs involving a return current toward the throttle channel 421. Thus, as shown in FIG. 7, an actual interface position 52 may be established upstream of the standard interface position S1.

When water is ejected from the throttle channel 421, negative pressure is produced in that region of the aeration unit 43 where water does not exist. Air is drawn in through the air introduction holes 421*a* by the action of the negative pressure, producing an airflow AF. Thus, a negative suction pressure portion LPb is formed near the air introduction holes 431*a* to draw air into the aeration unit 43. The negative suction pressure portion LPb allows air to be drawn in through the air introduction holes 431*a* and affects the water stream WF ejected from the throttle channel 421. Specifically, the water stream WF ejected from the throttle channel 421 is pulled toward the flange 4Cb by the negative suction pressure portion LPb so as to block the air introduction holes 431*a*.

As shown in FIG. 10, when the water stream WF ejected from the throttle channel 421 is pulled by the negative suction pressure portion LPb, the air-liquid interface is established at an interface position S3 by moving upstream. When the air-liquid interface moves to the interface position S3, the air introduction holes 431*a* become substantially blocked. Consequently, the negative pressure of the negative suction pressure portion LPb falls, reducing the volume of air taken in through the air introduction holes 431*a*.

In the shower apparatus F1 according to the present embodiment, the flow channel from the water supply unit 41 to the throttle unit 42 is shaped like an elbow to form an elbow portion EP so that the water stream WF ejected to the aeration unit 43 from the throttle channel 421 of the throttle unit 42 will be separated from a wall surface of the throttle unit 42 (bottom face of the cavity 4A). More specifically, to create abrupt surface changes in part of an inner circumferential surface of the elbow portion EP, an inner surface 422*a* on the upstream side and inner surface 422*b* on the downstream side are connected, forming a corner portion 421*a*. This configuration can cause flow separation when the water stream WF passes the corner portion 421*a* and thereby generate a large swirl downstream of the corner portion 421*a*. The large swirl generates centrifugal force, causing a negative interflow pressure portion LPa to be produced in the water stream ejected from the throttle channel 421.

In the state shown in FIG. 10, since the negative pressure generated by the negative suction pressure portion LPb falls, the negative pressure generated by the negative interflow pressure portion LPa rises in a relative sense and the water stream WF ejected from the throttle channel 421 is brought back to a more straight course. Since the water stream WF ejected from the throttle channel 421 moves straight by the action of the negative interflow pressure portion LPa, the state shown in FIG. 9 is resumed. By the interaction of the negative suction pressure portion LPb and negative interflow pressure portion LPa described above, the water stream WF ejected from the throttle channel 421 vibrates in a direction which intersects the ejection direction. In the shower apparatus F1 according to the present embodiment, the instantaneous flow rate of the bubbly water sent out to the nozzle unit 44 from the aeration unit 43 can be varied greatly by the interaction between the vibrations of the water stream WF ejected from the throttle channel 421 and periodic variation in the volume of air taken in through the air introduction holes 431*a*.

Figures 11A, 11B, 11C, 11D:
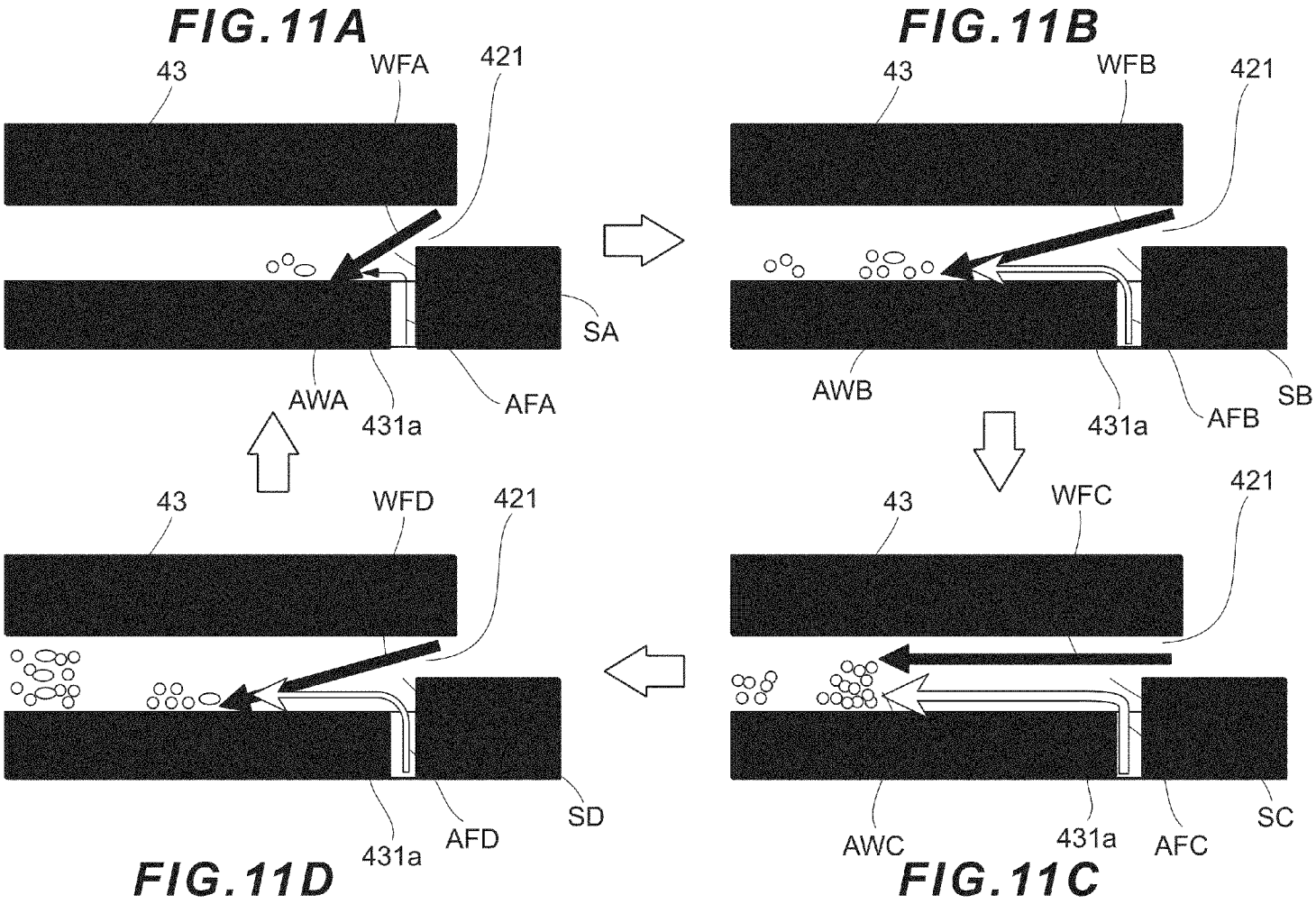
FIGS. 11A to 11D are diagrams for illustrating changes in a traveling direction of a water stream and changes in a state of bubble inclusion.

Further description will be given with reference to FIGS. 11A to 11D in addition to the description given with reference to FIGS. 9 and 10. FIGS. 11A to 11D are diagrams schematically showing a relationship between the traveling direction of a water stream and a region in which air is taken into water. In FIG. 11A, a water stream WFA comes closest to the air introduction holes 431*a*. In FIG. 11B, the water stream WFA changes its traveling direction from that shown in FIG. 12A and a resulting water stream WFB moves away from the air introduction holes 431*a*. In FIG. 11C, the water stream WFB further changes its traveling direction from that shown in FIG. 11B and a resulting water stream WFC moves to a position most distant from the air introduction holes 431*a*, where the water stream WFC no longer collides with the wall surface of the aeration unit 43. In FIG. 11D, the water stream WFC further changes its traveling direction farther from that shown in FIG. 11C and a resulting water stream WFD comes close to the air introduction holes 431*a*.

As shown in FIG. 11A, when the water stream WFA ejected from the throttle unit 42 approaches the air introduction holes 431*a* which are openings, naturally the position at which the water stream WFA collides with the wall surface of the aeration unit 43 approaches the air introduction holes 431*a*. In this case, an air-liquid interface SA which is a boundary between water and air is formed at a location relatively close to the'air introduction holes 431*a*.

Airflow AFA introduced the air introduction holes 431*a* proceeds toward the air-liquid interface SA. Since the air-liquid interface SA is formed along the water stream WFA, the airflow AFA is rarely taken into the water in most part of the air-liquid interface SA. Near where the water stream WFA collides with the wall surface of the aeration unit 43, the airflow AFA accelerates and collides with the air-liquid interface SA, and thus an air intake area AWA is also formed in which air is torn off the airflow AFA and taken into the water stream WFA. In the state shown in FIG. 11A, since the air intake area AWA is relatively close to the air introduction holes 431*a*, the airflow AFA has a short acceleration distance, and consequently a small volume of air is taken in.

In FIG. 11A, negative suction pressure acting to draw in air through the air introduction holes 431*a* is low and the negative interflow pressure produced above the water stream WFA is high. Thus, the water stream WFA ascends by being pulled by the negative interflow pressure and becomes the water stream WFB shown in FIG. 11B.

As shown in FIG. 11B, when the water stream WFB ejected from the throttle unit 42 moves away from the air introduction holes 431*a* which are openings, naturally the position at which the water stream WFB collides with the wall surface of the aeration unit 43 also moves away from the air introduction holes 431*a*. In this case, an air-liquid interface SB which is a boundary between water and air is formed at a location away from the air introduction holes 431*a*.

Airflow AFB introduced through the air introduction holes 431*a* proceeds toward the air-liquid interface SB. Since the air-liquid interface SB is formed along the water stream WFB, the airflow AFB is rarely taken into the water in most part of the air-liquid interface SE. Near where the water stream WFB collides with the wall surface of the aeration unit 43, the airflow AFB accelerates and collides with the air-liquid interface SB, and thus an air intake area AWB is also formed in which air is torn off the airflow AFB and taken into the water stream WFB. In the state shown in FIG. 11E since the air intake area AWB is located away from the air introduction holes 431*a*, the airflow AFT has a long acceleration distance, and consequently a large volume of air is taken in.

In FIG. 11B, the negative suction pressure acting to draw in air through the air introduction holes 431*a* is higher than in FIG. 11A, but the negative interflow pressure produced above the water stream WFB is still higher. Thus, the water stream WFB ascends by being pulled by the negative interflow pressure and becomes the water stream WFC shown in FIG. 11C.

As shown in FIG. 11C, when the water stream WFC ejected from the throttle unit 42 becomes horizontal by moving away from the air introduction holes 431*a* which are openings, the water stream WFC no longer collides with the wall surface of the aeration unit 43. In this case, an air-liquid interface SC which is a boundary between water and air is formed at a location most distant from the air introduction holes 431*a*.

Airflow AFC introduced through the air introduction holes 431*a* proceeds toward the air-liquid interface SC. Since the air-liquid interface SC is formed along the water stream WFC, the airflow AFC is rarely taken into the water in most part of the air-liquid interface SC. In FIG. 11C, since the water stream WFC does not collide with the wall surface, the air-liquid interface SC is formed by getting into the location where the water pressure and negative suction pressure become balanced. In this location, the airflow AFC accelerates and collides with the air-liquid interface SC, and thus an air intake area AWC is also formed in which air is torn off the airflow AFC and taken into the water stream WFC. In the state shown in FIG. 11C, since the air intake area AWC is located farthest away from the air introduction holes 431*a*, the airflow AFC has the longest acceleration distance, and consequently the largest volume of air is taken in.

In FIG. 11C, the negative suction pressure acting to draw in air through the air introduction holes 431*a* is high and the negative interflow pressure produced above the water stream WFA is low. Thus, the water stream WFC descends by being pulled by the negative suction pressure and becomes the water stream WFD shown in FIG. 11D.

As shown in FIG. 11D, when the water stream WFD ejected from the throttle unit 42 approaches the air introduction holes 431*a* which are openings, naturally the position at which the water stream WFD collides with the wall surface of the aeration unit 43 approaches the air introduction holes 431*a*. In this case, an air-liquid interface SD which is a boundary between water and air is formed at a location close to the air introduction holes 431*a*.

Airflow AFD introduced through the air introduction holes 431*a* proceeds toward the air-liquid interface SD. Since the air-liquid interface SD is formed along the water stream WFD, the airflow AFD is rarely taken into the water in most part of the air-liquid interface SD. Near where the water stream WFD collides with the wall surface of the aeration unit 43, the airflow AFD accelerates and collides with the air-liquid interface SD, and thus an air intake area AWD is also formed in which air is torn off the airflow AFD and taken into the water stream WFD. In the state shown in FIG. 11D, since the air intake area AWD is close to the air introduction holes 431*a*, the airflow AFD has a short acceleration distance, and consequently a small volume of air taken in.

In FIG. 11D, the negative suction pressure acting to draw in air through the air introduction holes 431*a* is lower than in FIG. 11C but relatively higher than the negative interflow pressure produced above the water stream WFD. Thus, the water stream WFD descends by being pulled by the negative suction pressure and returns to the state of the water stream WFA shown in FIG. 11A.

In this way, as pulsation mechanism changes the distance from the air introduction holes 431*a* which are openings to the air intake area (AWA to AWD), it becomes possible to maintain the volume of air taken in through the air introduction holes 431*a* at a sufficient level or decrease the volume of air taken in through the air introduction holes 431*a*.

Specifically, by changing the distance from the air introduction holes 431*a* to the air intake area, the pulsation mechanism changes the acceleration distance for accelerating the air by running from the air introduction holes 431*a* to the air intake area (AWA to AWU) and thereby changes flow velocity of the air plunging into the air intake area. If the flow velocity of the air plunging into the air intake area (AWA to AWU) increases, an amount of inclusion in the air intake area (AWA to AWD) increases, increasing the amount of negative suction pressure in the aeration unit 43.

On the other hand, if the flow velocity of the plunging into the air intake area (AWA to AWD) decreases, the amount of air inclusion in the air intake area (AWA to AND) decreases, decreasing the amount of negative suction pressure in the aeration unit 43. Thus, by changing the distance from the air introduction holes 431*a* to the air intake area (AWA to AND), the amount of negative suction pressure of air in the aeration unit 43 can be varied reliably. In this way, by simply changing the distance from the air introduction holes 431*a* to the air intake area (AWA to AND) and thereby varying the amount of negative suction pressure of air, the volume of air intake can be varied reliably, making it possible to realize pulsating spray with a comfortable stimulus sensation of the instantaneous flow rate of the spray varying greatly in a reliable manner.

Also, preferably the pulsation mechanism forms the air take area (AWA to AWD) by causing the water stream (WFA to WFD) ejected to the aeration unit 43 from the throttle unit 42 to collide with the wall surface (lower wall surface in FIG. 11) facing the air side of the air-liquid interface (SA to SD), i.e., that wall surface of the aeration unit 43 which is located on the side on which air exists, and changes the distance from the air introduction holes 431*a* to the air intake area (AWA to AWD) by changing the location of the collision.

The shower apparatus F1 according to the present embodiment allows the user to have a comfortable stimulus sensation, by greatly varying the instantaneous flow rate of spray. To achieve the comfortable stimulus sensation, the amount of negative suction pressure of air in the aeration unit 43 is varied, thereby reliably varying the volume of air taken into the aeration unit 43. In order for the user to have a comfortable stimulus sensation, it is necessary to reduce a period of pulsating spray. This is because if the period of pulsating spray increases, intervals of changes in the volume of water hitting the user increases as well, making it difficult for the user to have a stimulus sensation.

Thus, as described above, in order to reduce variation periods of both the amount of negative suction pressure and volume of air intake, the air intake area (AWA to AWD) formed by causing the water stream (WFA to WFD to collide with that wall surface of the aeration unit 43 which is located on the side on which air exists and the distance froth the air introduction holes 431*a* to the air intake area (AWA to AWD) is changed by changing the location of the collision. Since the air intake area (AWA to AWD) is formed in part of the air-liquid interface (SA to SD), it is conceivable to change the acceleration distance of air by changing the distance between the entire air-liquid interface (SA to SD) and the air introduction holes 431*a*.

However, the air-liquid interface (SA to SD) is generated by balance between internal pressure of water temporarily pooled in the aeration unit 34 and negative suction pressure drawing air into the aeration unit 34 and location of the air-liquid interface coincides with location where the internal pressure of water and negative suction pressure of air become balanced. Therefore, to change the distance between the air-liquid interface (SA to SD) and air introduction holes 431*a*, it is necessary to change the balance between the internal pressure of water and negative suction pressure of air but the distance cannot be varied, for example, by just slightly changing the traveling direction of the water stream ejected from the throttle unit 42.

Thus, the air intake area (AWA to AWD) is formed forcibly by causing the water stream to collide with that wall surface of the aeration unit 43 which is located on the side on which air exists and location of the air intake area (AWA to AWD) is varied by adjusting the traveling direction of the water stream instead of manipulating pressure balance. In this way, the location of collision between the water stream and wall surface is moved reliably by changing the traveling direction of the water stream, and the distance from the air introduction holes 431*a* to the air intake area (AWA to AWD) is changed reliably.

Also, when periodically changing the traveling direction of the water stream (WFA to WFD) ejected to the aeration unit 43 from the throttle unit 42, the pulsation mechanism temporarily changes the traveling direction to avoid collision with the wall surface of the aeration unit 43, maximizing the volume of air taken into the aeration unit 43 (see FIG. 11C).

As described above, the location of the air-liquid interface (SA to SD) coincides with the location where the internal pressure of water temporarily pooled in the aeration unit 43 and negative suction pressure drawing air into the aeration unit become balanced. On the other hand, the air intake area (AWA to AWD), which is part of the air-liquid interface (SA to SD) and is formed by causing the water stream to collide with the wall surface, is formed by pulling out part of the air-liquid interface toward the opening side. Thus, according to this preferred aspect, when the traveling direction of the water stream ejected to the aeration unit from the throttle unit is periodically changed, the traveling direction is temporarily changed to avoid collision with the wall surface, and consequently the location of the air intake area is pulled away to the location where the internal, pressure of water and negative pressure of air become balanced. This increases the distance between the aeration unit and opening, maximizing the volume of air taken into the aeration unit.

Also, in a water discharge apparatus according to the present invention, preferably when periodically changing the traveling direction of the water stream ejected to the aeration unit from the throttle unit, the pulsation mechanism changes the traveling direction of the water stream so as to cause a collision at a location close to a downstream side of the opening in the aeration unit to minimize the volume of air taken into the aeration unit.

As described above, according to a preferred aspect of the present invention, the volume of air taken in through the opening is maintained at a sufficient level or the volume of air taken in through the opening is decreased by varying the location of the air intake area. According to this preferred aspect, to greatly vary the volume of air taken in through the opening, the traveling direction of the water stream ejected from the throttle unit is changed so as to cause a collision at a location close to the downstream side of the opening in the aeration unit. In this way, by changing the traveling direction of the water stream, this configuration moves the location of the air intake area toward the opening side, thereby minimizes the volume of air taken into the aeration unit, and thereby maximizes the variation in the volume of air intake. Thus, the volume of air intake can be varied greatly in a reliable manner, making it possible to realize pulsating spray with a comfortable stimulus sensation of the instantaneous flow rate of spray varying greatly in a reliable manner.

Also, in the water discharge apparatus according to the present invention, preferably when periodically changing the traveling direction of the water stream ejected from the throttle unit, the pulsation mechanism changes the traveling direction of the water stream without interfering with the opening, and thereby prevents water from flowing out of the opening.

Since the opening in the water discharge apparatus according to the present invention is intended to take air into the aeration unit, any outflow of water through the opening is an unintended water discharge and is not only undesirable, but also can clog the opening with a calcium component in the water adhering to the inside of the opening. Thus, according to this preferred aspect, the traveling direction of the water stream ejected from the throttle unit is changed without interfering with the opening to prevent water from flowing out of the opening.

As described above, the shower apparatus F1 according to the present embodiment is an example of the water discharge apparatus for discharging aerated bubbly water and is equipped with the water supply unit 41 adapted to supply water; the throttle unit 42 installed downstream of the water supply unit 41 and adapted to make the cross sectional area of the flow channel smaller than that of the water supply unit 41 and thereby eject passing water downstream at increased flow velocity; the aeration unit 43 installed downstream of the throttle unit 42 and provided with the air introduction holes 431*a* serving as an opening adapted to produce the bubbly water by aerating the water stream ejected through the throttle unit 42; and the nozzle unit 44 serving as a water discharge unit adapted to discharge the bubbly water generated by the aeration unit 43.

Furthermore, the shower apparatus F1 varies the volume of air taken into the aeration unit 43 by causing the water stream ejected to the aeration unit 43 from the throttle unit 42 to vibrate in a direction intersecting the ejection direction and produces pulsating spray by greatly varying the instantaneous flow rate of the bubbly water discharged from the nozzle unit 44 serving as a water discharge unit. In other words, the shower apparatus F1 varies the volume of air taken into the aeration unit 43 by periodically changing the traveling direction of the water stream ejected to the aeration unit 43 from the throttle unit 42 and produces pulsating spray by greatly varying the instantaneous flow rate of the bubbly water discharged from the nozzle unit 44 serving as the water discharge unit. The concept of "periodically" is not limited to changing the traveling direction of the water stream always at the same frequency, and includes continuous, time-series changes in the traveling direction of the water stream (which may be momentarily discontinuous).

As one form of the pulsation mechanism adapted to greatly vary the instantaneous flow rate of the bubbly water discharged from the nozzle unit 44, the shower apparatus F1 according to the present embodiment includes the negative interflow pressure portion LPa and negative suction pressure portion LPb. Under the action of the negative interflow pressure portion LPa and negative suction pressure portion LPb, the shower apparatus F1 varies the amount of negative suction pressure of air in the aeration unit 43 by causing the water stream WF ejected to the aeration unit 43 from the throttle unit 42 to vibrate in the direction intersecting the ejection direction, varies the amount of negative suction pressure in the aeration unit 43, and thereby varies the volume of air taken into the aeration unit 43.

With the shower apparatus F1 according to the present embodiment, since the aeration unit 43 produces the bubbly water by aerating the water stream WF ejected from the throttle unit 42 and the bubbly water is discharged from the nozzle unit 44 serving as the water discharge unit, the user can enjoy spray of water with a voluminous feel. Furthermore, since the shower apparatus F1 is equipped with the pulsation mechanism adapted to produce pulsating spray by greatly varying the instantaneous flow rate of the bubbly water discharged from the nozzle unit 44, the user can enjoy spray of water with a comfortable stimulus sensation of an instantaneous flow rate of the spray varying greatly. When producing pulsating spray, the pulsation mechanism causes the water stream WF ejected from the throttle unit 42 to vibrate in the direction intersecting the ejection direction (periodically changes the traveling direction of the water stream), and thereby varies the volume of air taken into the aeration unit 43. Since the pulsation Mechanism causes the water stream WF ejected from the throttle unit 42 to vibrate in the direction intersecting the ejection direction (periodically changes the traveling direction of the water stream), varies the volume of air taken into the aeration unit 43 using the vibrations (changes), and furthermore produces pulsating spray using the variation in the volume of air, the pulsating spray can be produced as a result by simply changing the traveling direction of the water stream WF. Consequently, a simple configuration conducive to cost and size reductions can implement the water discharge apparatus F1 which allows the user to enjoy pulsating spray with a voluminous feel even when a small volume of water is discharged as well as with a comfortable stimulus sensation of an instantaneous flow rate of the spray varying greatly.

The pulsation mechanism vibrates the water stream in the direction intersecting the ejection direction (periodically changes the traveling direction of the water stream), varies the amount of negative suction pressure in the aeration unit 43 using the vibrations (changes), and thereby varies the force sucking air into the aeration unit 43. Consequently, the volume of air taken into the aeration unit 43 can be varied reliably by simply varying the amount of negative suction pressure used to suck air into the aeration unit 43. Thus, without using a pump or other special means of varying air sent into the aeration unit 43, a simple configuration conducive to further cost and size reductions makes it possible to realize pulsating spray with a comfortable stimulus sensation of the instantaneous flow rate of the spray varying greatly in a reliable manner.

Also, the shower apparatus F1 according to the present embodiment is configured such that the air-liquid interface will be formed downstream of the air introduction holes 431*a* within the aeration unit 43 and that bubbly water will be produced when the water stream WF ejected from the throttle unit 42 plunges into the air-liquid interface. The pulsation mechanism varies the amount of negative suction pressure in the aeration unit 43 by moving the location of the air-liquid interface, and thereby varies the volume of air taken into the aeration unit 43. More specifically, the air intake area is formed in part of the air-liquid interface to tear off air flowing in through the air introduction holes 431*a* and take the air into the water stream. The pulsation mechanism varies the amount of negative suction pressure in the aeration unit 43 by changing the distance from the air introduction holes 431*a*, connected to the opening, to the air intake area and thereby varies the volume of air taken into the aeration unit 43.

According to the present embodiment, by moving the location of the air-liquid interface, the pulsation mechanism can maintain the volume of air taken in through the air introduction holes 431*a* at a sufficient level or decrease the volume of air taken in through the air introduction holes 431*a*. Thus, by moving the location of the air-liquid interface, the amount of negative suction pressure of air in the aeration unit 43 can be varied reliably. In this way, by simply moving the air-liquid interface and thereby varying the amount of negative suction pressure of air, the volume of air intake can be varied reliably, making it possible to realize pulsating spray with a comfortable stimulus sensation of the instantaneous flow rate of the spray varying greatly in a reliable manner.

According to the present embodiment, by moving the location of the air-liquid interface upstream and positioning the air-liquid interface sc as to block air introduction holes 431*a*, the pulsation mechanism reduces the amount of negative suction pressure in the aeration unit 43 and thereby reduces the volume of air taken into the aeration unit 43.

According to the present embodiment, by varying the location of the air-liquid interface, the volume of air taken in through the introduction holes 431*a* is maintained at a sufficient level or the volume of air taken in through the air introduction holes 431*a* is decreased. To greatly vary the volume of air taken in through the air introduction holes 431*a*, the air-liquid interface is positioned so as to block the introduction holes 451*a* by moving the location of the air-liquid interface upstream. In this way, by moving the air-liquid interface to such a position as to block the air introduction holes 431*a* the volume of air taken into the aeration unit 43 is minimized and the variation in the volume of air intake is maximized. Thus, the volume of air intake can be varied greatly in a reliable manner, making it possible to realize pulsating spray with a comfortable stimulus sensation of the instantaneous flow rate of the spray varying greatly in a reliable manner.

Also, in the shower apparatus F1 according to the present embodiment, the pulsation mechanism causes the water stream WF ejected to the aeration unit 43 from the throttle unit 42 to be separated from a wall surface of the throttle unit 42, forms the negative interflow pressure portion LPa between the water stream WF and wall surface by means of the flow separation, and thereby vibrates the water stream WF. Thus, this configuration also functions as separation facilitating means adapted to cause the water stream WF ejected to the aeration unit 43 from the throttle unit 42 to be separated from the wall surface of the throttle unit 42.

In this way, since the water stream WF ejected from the throttle unit 42 is separated from the wall surface of the throttle unit 42, forming the negative interflow pressure portion LPa between the water stream WF and wail surface by means of the flow separation, the water stream WF ejected from the throttle unit 42 can be vibrated by the action of the negative interflow pressure portion LPa. In this way, since the water stream WF is vibrated by simply separating the water stream WF from the wall surface and thereby forming the negative interflow pressure portion LPa, the volume of air intake can be varied using an extremely simple configuration. Thus, without using a special means of vibrating the water stream WF, a simple configuration conducive to further cost and size reductions makes it possible to realize pulsating spray with a comfortable stimulus sensation of the instantaneous flow rate of the spray varying greatly in a reliable manner.

Also, the pulsation mechanism according to the present embodiment includes the negative interflow pressure portion LPa formed upstream of the negative suction pressure portion LPb used to suck air to the aeration unit 43 under negative pressure. In this way, since the negative interflow pressure portion LPa is formed upstream of the negative suction pressure portion LPb, the amount of negative pressure generated by the negative suction pressure portion LPb located downstream can be varied by the negative pressure generated by the negative interflow pressure portion LPa when the water stream WF ejected from the throttle unit 42 is separated from the wall surface. Thus, the water stream WF can be vibrated by the difference between the negative pressure generated by the negative interflow pressure portion LPa and the negative pressure generated by the negative suction pressure portion LPb.

Also, the shower apparatus F1 according to the present embodiment is configured such that the air introduction holes 431*a* are formed only on the side opposite to the negative interflow pressure portion LPa to prevent the air sucked through the air introduction holes 431*a* from entering the negative interflow pressure portion LPa. In this way, an arrangement of the air introduction holes 431*a* and negative interflow pressure portion LPa can be devised so as to generate negative pressure easily without mixing air into the negative interflow pressure portion LPa and thereby ensure that necessary negative pressure will be available.

Also, in the shower apparatus F1 according to the present embodiment, the throttle channel 421 formed in the throttle unit 42 is flat-shaped relative to the ejection direction of the water stream WF to cause the water stream ejected to the aeration unit 43 to become a sheet-like stream of water. As the throttle channel 421 is formed in this way, the sheet-like stream of water ejected to the aeration unit 43 from the throttle unit 42 is configured to prevent the air sucked through the introduction holes 431*a* from entering the negative interflow pressure portion LPa.

In this way, since the flat throttle channel 421 is formed in the throttle unit 42, the water stream WF ejected from the throttle channel 421 becomes a sheet-like stream of water. Thus, since the sheet-like stream of water can be interposed between the air introduction holes 431*a* and negative interflow pressure portion LPa, the air taken in through the air introduction holes 431*a* does not reach the negative interflow pressure portion LPa by being interrupted by the sheet-like stream of water. In this way, by simply making cross-sectional shape of the throttle channel 421 flat, it is possible to generate negative pressure easily without mixing air into the negative interflow pressure portion LPa and thereby ensure that necessary negative pressure will be available.

Also, in the shower apparatus F1 according to the present embodiment, using a convex portion formed in wall surface of the throttle unit 42, the pulsation mechanism and separation facilitating means cause the water stream WF ejected to the aeration unit 43 from the throttle unit 42 to be separated from the wall surface of the throttle unit 42. More specifically, the flow channel from the water supply unit 41 to the throttle unit 42 is shaped like an elbow to form the elbow portion EP serving as the convex portion so that the water stream WF ejected to the aeration unit 43 from the throttle unit 42 will be separated from the wall surface of the throttle unit 42. In at least part of the inner circumferential surface of the elbow portion EP, the inner surface 422*a* on the upstream side and inner surface 422*b* or the downstream side are connected, forming the corner portion 421*a*.

In this way, by forming the convex portion in the wall surface of the throttle unit 42, abrupt surface changes can be created using a simple configuration. As the flow channel from the water supply unit 41 to the throttle unit 42 is shaped like an elbow to form the elbow portion EP, surface changes are created by bending the flow channel. Furthermore, by connecting the inner surface 422*a* on the upstream side and inner surface 422*b* on the downstream side each other in part of the inner circumferential surface of the elbow portion EP so as to form the corner portion 421*a*, abrupt surface changes can be created using a simple configuration. This makes it possible to cause separation of the water stream WF flowing through the throttle unit 42 using a simple configuration and thereby ensure that necessary negative pressure will be available.

Also, the shower apparatus F1 according to the present embodiment has the nozzle unit 44 as the water discharge unit. The nozzle unit 44 is provided with the plurality of nozzle holes 443 used to discharge bubbly, water, allowing a shower to be sprayed. This configuration allows the user to enjoy spray of a shower with a voluminous feel even when a small volume of water is discharged as well as with a comfortable stimulus sensation of an instantaneous flow rate of the spray varying greatly. However, when the present invention is viewed as a water discharge apparatus, embodiments of the present invention are not limited to the shower apparatus F1. Preferable forms also include a sanitary cleansing apparatus equipped with a water discharge unit having a single water discharge hole and configured to deliver a spray of water with both a voluminous feel and stimulus sensation through the single water discharge hole.

Also, the shower apparatus F1 according to the present embodiment is configured such that the throttle channel 421 will eject the water stream WF by shifting the water stream WF toward a wall surface located opposite the wall surface in which the air introduction holes 431*a* serving as openings are formed. This configuration allows the water stream WF to be ejected so as to increase a space on the side of the wall surface in which the air introduction holes 431*a* are formed and decrease a space on the opposite side of the water stream WF. This ensures that the negative pressure generated by the negative suction pressure portion LPb will be larger than the negative pressure generated by the negative interflow pressure portion LPa and that the water stream ejected in a sheet-like pattern will be vibrated.

Also, in the shower apparatus F1 according to the present embodiment, the throttle channel 421 ejects the water stream radially so that the ejected water stream will become a disk-shaped sheet-like stream WFc contiguous over the entire circumference. When the water stream is ejected in this way, the water stream ejected from the throttle channel 421 has no side edge which would interfere with wall surfaces of the flow channel. This makes it possible to avoid velocity drops caused by interference between side edges of the ejected water stream and wall surfaces of the flow channel and reliably vibrate the entire sheet-like stream.

Also, the shower apparatus F1 according to the present embodiment is configured such that a virtual water ejection straight line obtained by extending the ejection direction of the water ejected from the throttle unit 42 reaches the location of the nozzle holes 443 without interfering with inner walls of the aeration unit 43 and nozzle unit 44.

With this configuration, the water ejected from the throttle unit 42 reaches the location where the nozzle holes 443 are formed without having its flow disturbed by the inner walls of the aeration unit 43 and nozzle unit 44. In a stage in which the water ejected through the throttle unit 42 plunges into the air-liquid interface and thereby turns into bubbly water, the air bubbles in the bubbly water can be configured to have a substantially uniform diameter. Thus, the bubbly water can reach the location where the nozzle holes 443 are formed while maintaining the substantially uniform diameter. As the bubbly water containing air bubbles of such a substantially uniform diameter is supplied to the nozzle holes 443, a bubble flow or slug flow can be formed in the nozzle holes 443 and just after discharge from the nozzle holes 443. When discharged from the nozzle holes, the bubbly water containing air bubbles such a substantially uniform diameter and formed as a bubble flow or slug flow in this way is finely divided substantially uniformly by being sheared in a direction substantially orthogonal to a discharge direction without being turned into a mist as in the case of an annular flow. This causes water droplets of relatively larger uniform size to land continuously on the user and thereby ensures that the user will enjoy a shower with a voluminous feel as if the user were showered by large drops of rain.

Also, according to the present embodiment, the pulsation mechanism periodically changes the traveling direction of the water stream ejected from the throttle unit 42, using a pressure difference between the negative suction pressure generated to suck air into the aeration unit 43 through the air introduction holes 431*a* and the negative interflow pressure, increasing the negative interflow pressure when the negative suction pressure decreases, and decreasing the negative interflow pressure when the negative suction pressure increases.

In this way, the negative suction pressure and negative interflow pressure can be caused to exert a greater force alternately on the water stream ejected from the throttle unit 42. Since the forces are exerted on the water stream by increasing the negative interflow pressure when the negative suction pressure is decreased, and decreasing the negative interflow pressure when the negative suction pressure is increased, the negative suction pressure and negative interflow pressure can be kept reliably from coming into balance and stopping periodic variation in the traveling direction of the water stream.

Figures 12A, 12B, 12C:
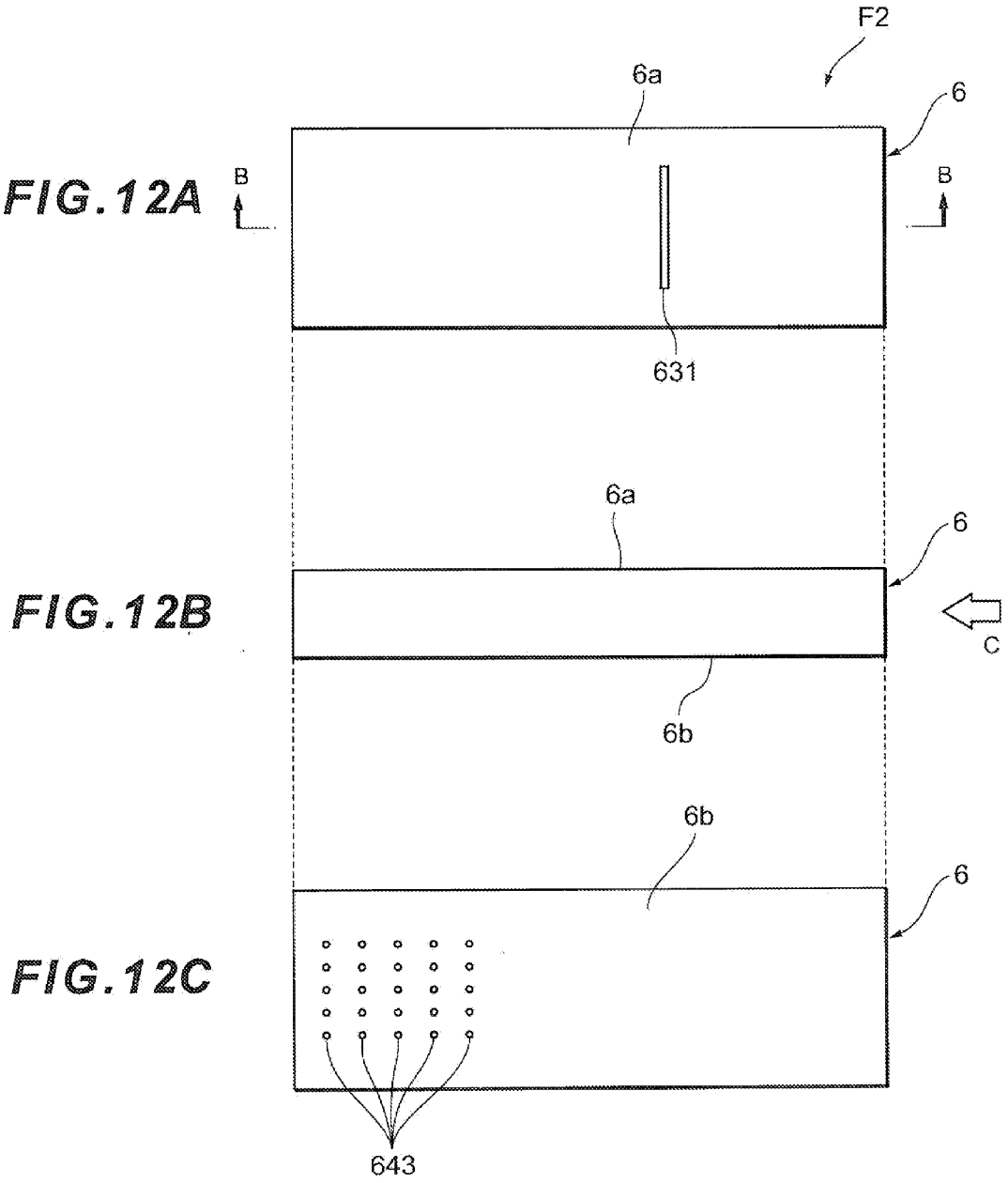
FIGS. 12A to 12C are diagrams showing a shower apparatus according to a second embodiment of the present invention, where

A shower apparatus which is a second embodiment of the present invention will be described with reference to FIGS. 12A to 12C, which are diagrams showing the shower apparatus F2 according to the second embodiment of the present invention, where FIG. 12A is a plan view, FIG. 12B is a side view, and FIG. 12C is a bottom view.

As shown in FIG. 12A, the shower apparatus F2 mainly includes a body 6 shaped as an approximately rectangular parallelepiped, and an opening 631 is formed in a top face 6*a* of the shower apparatus F2 (body 6). As shown in FIG. 12B, a plurality of nozzle holes 643 are provided in a bottom face 6*b* opposite the top face 6*a* of the shower apparatus F2. According to the present embodiment five rows by five columns of nozzle holes 643 are formed for a total of 25 nozzle holes as shown in FIG. 12C.

Figure 13:
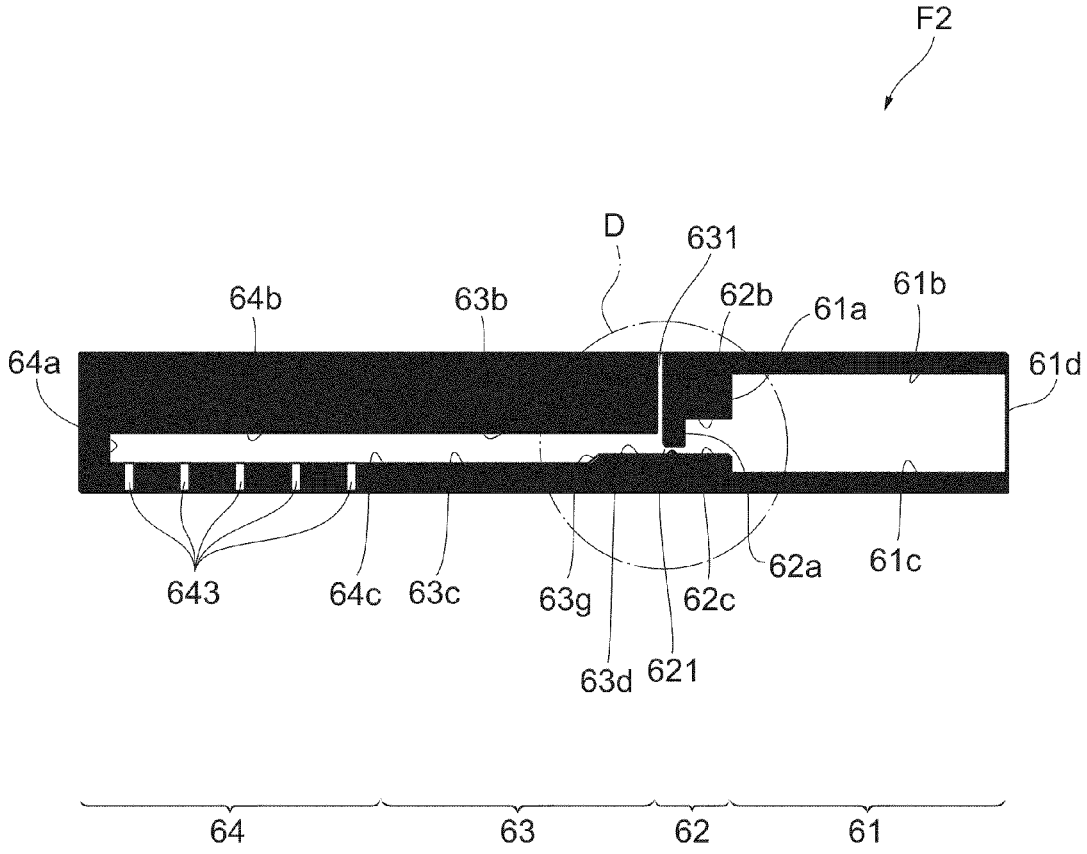
FIG. 13 is a sectional view taken along line B-B in FIG. 12.
Figure 14:
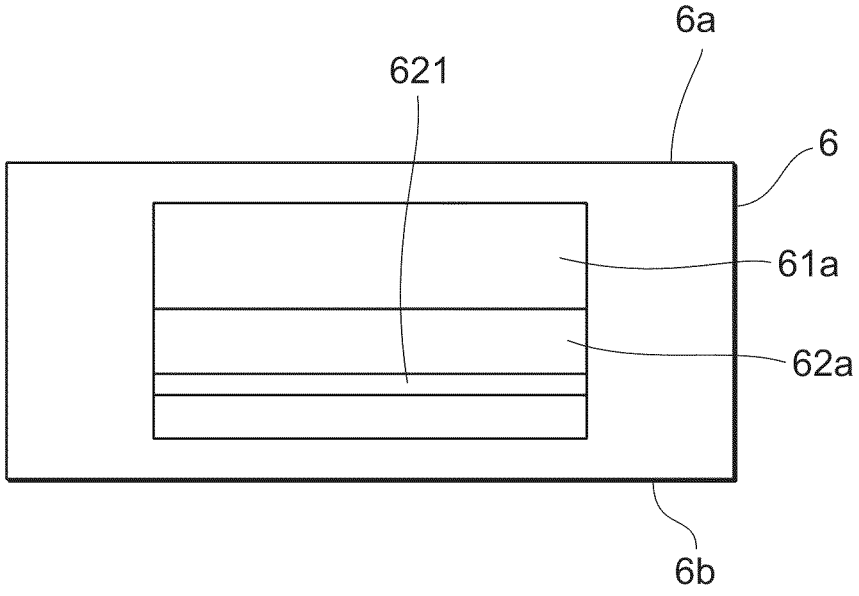
FIG. 14 is a view taken in the direction of arrow C in FIG. 12.

Next, the shower apparatus F2 will be described with reference to FIGS. 13 and 14, where FIG. 13 sectional view taken along line B-B in FIG. 12A and FIG. 14 is a view taken in the direction of arrow C in FIG. 123. As shown in FIG. 13, the shower apparatus F2 includes a water supply unit 61, throttle unit 62, aeration unit 63, and nozzle unit 64.

The water supply unit 61 is a part intended to supply water and adapted to supply water introduced through the water supply port 61*d* to the throttle unit 62. The water supply port 61*d* can be connected with water supply means (such as a water supply hose: not shown) and the water supplied through the water supply means is supplied from the water supply unit 61 to the throttle unit 62.

The throttle unit 62 is a part installed downstream of the water supply unit 61 and adapted to make the cross sectional area of a flow channel smaller than that of the water supply unit 61 and thereby eject passing water downstream. A single throttle channel 621 is installed in the throttle unit 62. The throttle channel 621 is formed into a flat, slit-like shape whose longer sides run along the direction perpendicular to the plane of the paper in FIG. 13.

FIG. 14 shows how the throttle channel 621 looks like. FIG. 14 is a view taken in the direction of arrow C in FIG. 12B. As shown in FIG. 14, the throttle channel 621 is formed into a flat, slit-like shape whose longer sides run along the top face 6*a* and bottom face 6*b* of the body 6.

Returning to FIG. 13, the other parts will be described. The aeration unit 63 is a part installed downstream of the throttle unit 62 and provided with the opening 631 used to aerate the water ejected through the throttle unit 62 and thereby turn the water into bubbly water.

The nozzle unit 64 (water discharge unit) is a part tailed downstream of the aeration unit 63 and provided with the plurality of nozzle holes 643 used to discharge bubbly water.

The water supply unit has a side wall 61*b* and side wall 61*c*. The side wall 61*b* and side wall 61*c* are formed to be longer in length along a direr orthogonal to the direction in which water proceeds than other side walls connected by the side wall 61*b* and side wall 61*c*. Thus, the water supply unit 61 is formed such that the cross section of the flow channel will have a flat shape. A front wall surface 61*a* is installed in a boundary portion between the water supply unit 61 and throttle unit 62, and the side walls 61*b* and 61*c* are connected to the front wall surface 61*a*.

The throttle unit 62 is installed in a region on the downstream side beyond the front wall surface 61*a*. The throttle unit 62 has a side wall 62*b* and side wall 62*c*. The side wall

Figure 15:
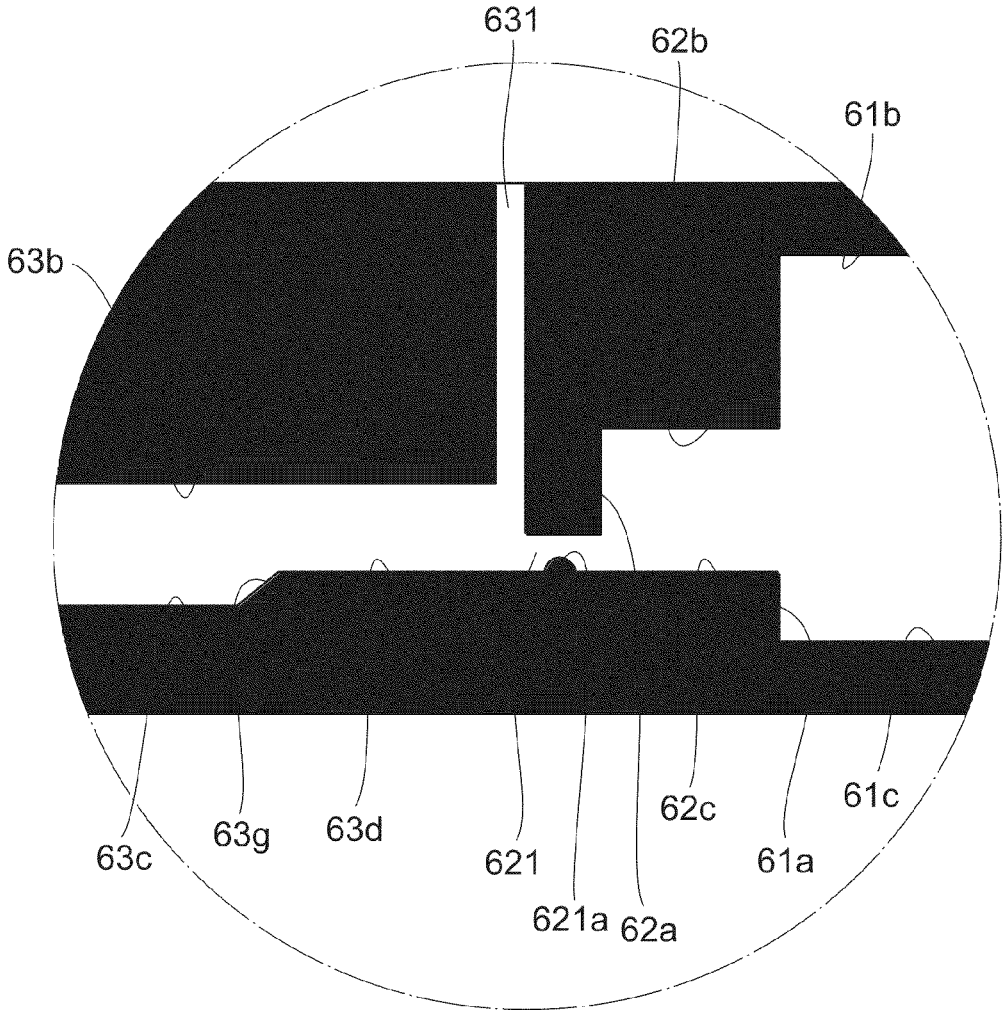
FIG. 15 is a side view.

62*b* and side wall 62*c* are formed to be longer in length along the direction orthogonal to the direction in which water proceeds than other side walls connected by the side wall 62*b* and side wall 62*c*. Thus, the throttle unit 62 is formed such that the cross section of the flow channel will have a flat shape. A partition wall 62*a* is installed in a boundary portion between the throttle unit 62 and aeration unit 63, and the side wall 62*b* and side wall 62*c* are connected to the partition wall 62*a*. The throttle channel 621 of a flat, slit-like shape is formed in the partition wall 62*a*. An enlarged view of region D around the throttle channel 621 is shown in FIG. 15. As shown in FIG. 15, a convex portion 621*a* is formed in the throttle channel 621, functioning as pulsation mechanism or separation facilitating means.

The aeration unit 63 is installed in a region on the downstream side beyond the partition wall 62*a*. The aeration unit 63 includes a side wall 63*b*, side wall 63*c*, and side wall 63*d*, where the side wall 63*c* is placed at a location opposite to and relatively distant from the side wall 63*b* while the side wall 63*d* is placed at a location opposite to and relatively close to the side wall 63*b*. The side wall 63*c* is placed on the side of the nozzle unit 64 while the side wall 63*d* is placed on the side of the throttle unit 62. Besides, a stepped portion 63*g* is formed, connecting the side wall 63*c* with the side wall 63*d*. The side walls 63*b*, 63*c*, and 63*d* are formed to be longer in length along the direction orthogonal to the direction in which water proceeds than other side walls connected by the side walls 63*b*, 63*c*, and 63*d*. Therefore, the aeration unit 63 is formed such that the cross section of the flow channel will have a flat shape.

The nozzle unit 64 is installed in a region downstream of the side wall 63*c*. The nozzle unit 64 includes a side wall 64*b* lying in the same plane as the side wall 63*b* of the aeration unit 63. Furthermore, the nozzle unit 64 includes a side wall 64*c* lying in the same plane as the side wall 63*c* of the aeration unit 63. The side walls 64*b* and 64*c* are connected to an inner-side side wall 64*a* which faces the water supply port 61*d* and functions as a terminal end of the flow channel. The nozzle holes 643 are formed in the side wall 64*c* of the nozzle unit 64.

Being configured as described above, the shower apparatus F2 according to the second embodiment achieves operation and effects equivalent to those achieved by the shower apparatus F1 according to the first embodiment. In particular, in the shower apparatus F2 according to the present embodiment, since the convex portion 621*a* is formed in a wall surface of the throttle unit 62, functioning as pulsation mechanism and separation facilitating means, the water stream ejected to the aeration unit 63 from the throttle unit 62 is separated from the side wall 62*c* which serves as a wall surface of the throttle unit 62.

In this way, by forming the convex portion 621*a* on the side wall 62*c* of the throttle unit 62, abrupt surface changes can be created using a simple configuration. This makes it possible to cause separation of the water stream flowing through the throttle unit 62 using a simple configuration and thereby ensure that necessary negative pressure will be available.

Figure 16:
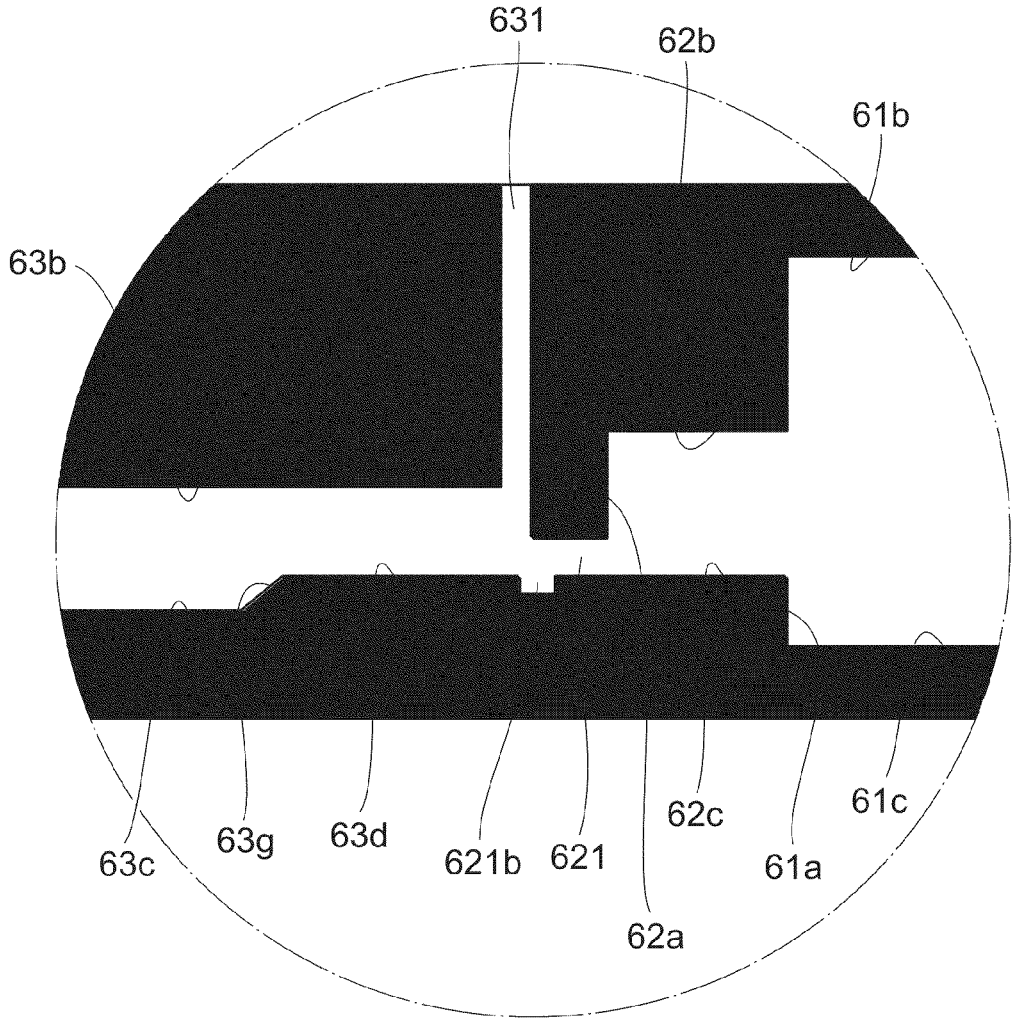
FIG. 16 is a diagram showing a variation of the part shown in FIG. 14.

However, from the standpoint of causing separation of the water stream, it is also preferable to provide a concave portion in the side wall 62*c*. An example of such a preferred form is shown in FIG. 16. In the example shown in FIG. 16, a concave portion 621*b* is formed in a wall surface of the throttle unit 62. As shown in FIGS. 15 and 16, if at least one of the concave portion 621*b* and convex portion 621*a* is formed on the side wall 62*c*, the water stream ejected to the aeration unit 63 from the throttle unit 62 is separated from the wall surface of the throttle unit 62.

Embodiments of the present invention have been described above with reference to concrete examples, However, the present invention is not limited to these concrete examples. That is, when those skilled in the art make design changes to any of the concrete examples, the resulting variations are also included in the scope of the present invention as long as the variations contain features of the present invention. For example, the components of the above-described concrete examples as well as the arrangements, materials, conditions, shapes, sizes, and the like of the components are not limited to those illustrated above, and may be changed as required. Also, the components of the above-described embodiments may be combined as long as it is technically possible, and the resulting combinations are also included in the scope of the present invention.

What is claimed is:

1. A water discharge apparatus comprising:

a water supply unit adapted to supply water;

a throttle unit installed downstream of the water supply unit and adapted to make a cross sectional area of a flow channel smaller than that of the water supply unit and thereby eject passing water downstream at increased flow velocity;

an aeration unit installed downstream of the throttle unit and provided with an opening adapted to produce bubbly water by aerating a water stream ejected through the throttle unit;

a water discharge unit adapted to discharge the bubbly water generated by the aeration unit; and pulsation mechanism adapted to periodically vary a volume of air taken into the aeration unit by periodically changing a traveling direction of the water stream ejected to the aeration unit from the throttle unit and produce pulsating spray by varying an instantaneous flow rate of the bubbly water discharged from the water discharge unit, wherein the pulsation mechanism comprises a negative interflow pressure portion which is configured to generate a negative pressure allowing the water stream ejected from the throttle unit to be pulled;

the negative interflow pressure portion is configured to form a flow of a swirl by the water stream ejected from the throttle unit, and to make the negative pressure by the flow of the swirl smaller when the water stream ejected from the throttle unit is pulled by the negative interflow pressure portion;

the negative interflow pressure portion is installed on a side opposite to the opening across the water stream ejected from the throttle unit; and the throttle unit is configured to provide the water stream ejected from the throttle unit between the opening and the negative interflow pressure portion, and to restrain the air introduced through the opening by the water stream ejected from the throttle unit from intruding the negative interflow pressure portion.

2. The water discharge apparatus according to claim 1, wherein the pulsation mechanism periodically changes the traveling direction of the water stream ejected to the aeration unit from the throttle unit, thereby varies an amount of negative suction pressure of air in the aeration unit, and thereby varies the volume of air taken into the aeration unit.

3. The water discharge apparatus according to claim 2, wherein:

an air-liquid interface which is a boundary between water and air is formed within the aeration unit and an air intake area is formed in part of the air-liquid interface to tear off air flowing in through the opening and take the air into the water stream; and the pulsation mechanism varies the amount of negative suction pressure of air in the aeration unit by changing a distance from the opening to the air intake area and thereby varies the volume of air taken into the aeration unit.

4. The water discharge apparatus according to claim 3, wherein the pulsation mechanism forms the air intake area by causing the water stream ejected to the aeration unit from the throttle unit to collide with a wall surface facing an air side of the air-liquid interface within the aeration unit and changes the distance from the opening to the air intake area by changing a location of the collision.

5. The water discharge apparatus according to claim 4, wherein when periodically changing the traveling direction of the water stream ejected to the aeration unit from the throttle unit, the pulsation mechanism temporarily changes the traveling direction to avoid collision with the wall surface of the aeration unit.

6. The water discharge apparatus according to claim 4, wherein when periodically changing the traveling direction of the water stream ejected to the aeration unit from the throttle unit, the pulsation mechanism changes the traveling direction of the water stream so as to cause a collision at a location close to a downstream side of the opening in the aeration unit.

7. The water discharge apparatus according to claim 4, wherein when periodically changing the traveling direction of the water stream ejected from the throttle unit, the pulsation mechanism changes the traveling direction of the water stream without interfering with the opening, and thereby prevents water from flowing out of the opening.

8. The water discharge apparatus according to claim 2, wherein the pulsation mechanism causes the water stream ejected to the aeration unit from the throttle unit to be separated from a wall surface of the throttle unit, forms a negative interflow pressure portion between the water stream and the wall surface by means of the flow separation, and thereby periodically changes the traveling direction of the water stream.

9. The water discharge apparatus according to claim 8, wherein the opening is formed only on a side opposite to the negative interflow pressure portion formed by the pulsation mechanism, to prevent the air sucked through the opening from entering the negative interflow pressure portion.

10. The water discharge apparatus according to claim 9, wherein:

a throttle channel which is flat-shaped relative to the ejection direction of the water stream is formed in the throttle unit to cause the water stream ejected to the aeration unit to become a sheet-like stream of water; and the sheet-like stream of water ejected to the aeration unit from the throttle unit is configured to prevent the air sucked through the opening from entering the negative interflow pressure portion.

11. The water discharge apparatus according to claim 8, wherein the pulsation mechanism periodically changes the traveling direction of the water stream ejected from the throttle unit, using a pressure difference between negative suction pressure generated to suck air into the aeration unit through the opening and the negative interflow pressure, increasing the negative interflow pressure when the negative suction pressure decreases, and decreasing the negative interflow pressure when the negative suction pressure increases.

* * * * *